US008689424B2

(12) United States Patent
Lee

(10) Patent No.: US 8,689,424 B2
(45) Date of Patent: Apr. 8, 2014

(54) FIFTY THREE FOOT UNIVERSAL STACKABLE CONTAINER

(75) Inventor: Teow Hua Lee, Singapore (SG)

(73) Assignee: APL Limited, Scottsdale, AZ (US)

( * ) Notice: Subject to any disclaimer, the term of this patent is extended or adjusted under 35 U.S.C. 154(b) by 628 days.

(21) Appl. No.: 12/840,618

(22) Filed: Jul. 21, 2010

(65) Prior Publication Data

US 2011/0017630 A1 Jan. 27, 2011

Related U.S. Application Data

(60) Provisional application No. 61/227,392, filed on Jul. 21, 2009.

(51) Int. Cl.
*B66C 1/66* (2006.01)

(52) U.S. Cl.
USPC ..... 29/525.01; 414/802; 220/1.5; 206/512

(58) Field of Classification Search
USPC ..... 29/525.01; 220/1.5; 206/509, 512; 414/801–803, 809, 812
See application file for complete search history.

(56) References Cited

U.S. PATENT DOCUMENTS

| | | | | |
|---|---|---|---|---|
| 3,966,075 | A | 6/1976 | Schultz | |
| 4,172,685 | A * | 10/1979 | Nabeshima et al. | 414/139.7 |
| 4,416,385 | A | 11/1983 | Clare et al. | |
| 4,505,402 | A | 3/1985 | Gerhard | |
| 4,599,027 | A * | 7/1986 | Knapp | 414/137.1 |
| 4,626,155 | A * | 12/1986 | Hlinsky et al. | 410/82 |
| 6,105,525 | A * | 8/2000 | Rapeli | 114/72 |
| 7,056,081 | B2 * | 6/2006 | Kelly | 414/792.9 |
| 7,341,422 | B1 * | 3/2008 | McCown et al. | 414/803 |
| 7,484,918 | B2 * | 2/2009 | Brewster | 410/69 |
| 7,841,284 | B2 * | 11/2010 | McCown | 114/65 R |

(Continued)

FOREIGN PATENT DOCUMENTS

| | | |
|---|---|---|
| CN | 2688656 | 3/2005 |
| CN | 101058363 | 10/2007 |
| CN | 201180021 Y | 1/2009 |
| CN | 101468742 | 7/2009 |

OTHER PUBLICATIONS

Office action dated Dec. 1, 2010 from CN patent application 200710301751.7, 4 pages.
International Search Report for Application No. PCT/US2010/042771, dated Feb. 15, 2011, 5 pages.

(Continued)

*Primary Examiner* — David Bryant
*Assistant Examiner* — Jason L Vaughan
(74) *Attorney, Agent, or Firm* — Kilpatrick Townsend & Stockton LLP

(57) ABSTRACT

One embodiment of the invention is directed to a shipping container forming a rectangular box shape, comprising a pair of side walls, a front wall and a rear wall coupled to the pair of side walls, a top wall coupled to the side walls and the rear walls, a bottom wall coupled to the side walls and the rear walls. The side walls, the front wall, the rear wall and the top wall form top corners. The sides walls, the front wall, the rear wall and the bottom wall form bottom corners. The shipping container further comprises a set of top corner fitting elements disposed at the top corners of the shipping container, each top corner fitting element having an outer aperture, and a set of bottom corner fitting elements disposed at the bottom corners of the shipping container, each bottom corner fitting element having an outer aperture.

10 Claims, 22 Drawing Sheets

(56) References Cited

U.S. PATENT DOCUMENTS

| | | | | |
|---|---|---|---|---|
| 8,007,214 | B2 * | 8/2011 | Brewster | 410/69 |
| 2003/0006233 | A1 | 1/2003 | Reynard | |
| 2008/0219804 | A1 * | 9/2008 | Chattey | 414/140.3 |
| 2010/0021272 | A1 * | 1/2010 | Ward et al. | 414/137.1 |

OTHER PUBLICATIONS

Written Opinion for Application No. PCT/US2010/042771, dated Feb. 15, 2011, 3 pages.

Notice of the First Office Action as issued in International Application No. 201090001031.4 on Aug. 31, 2012, 4 pages.

* cited by examiner

FIFTY THREE FOOT UNIVERSAL STACKABLE CONTAINER

CROSS-REFERENCES TO RELATED APPLICATIONS

The present application is a non-provisional application of and claims priority to U.S. Provisional Application No. 61/227,392, filed on Jul. 21, 2009, the entire contents of which are herein incorporated by reference for all purposes.

BACKGROUND

There are a variety of shipping containers to ship goods around the globe. Some of these containers are used to haul the goods using a trailer, and some are used to transport the goods using trains or vessels. Each type of transportation means (i.e., trailers, trains and vessels) must follow domestic and international guidelines that specify the size, dimensions and weight of the containers. Often, one type of container that is suitable for a kind of transportation means is not suitable for another type. As a result, goods that are shipped via vessels in a transpacific or transatlantic trades are offloaded from the type of containers used in the vessels and reloaded into containers used for trailers or trains. This process is costly, inefficient and cumbersome.

Moreover, containers come in different sizes such as a 40 foot container or a 53 foot container. It is desirable to use 53 foot containers for all forms of transportations since they offer more space. Currently, there are 53 foot containers that are used for vessels, but they do not provide the cubic capacity that is needed for international shipping. Additionally, adapters must be used to stack these containers on vessels which adds additional cost. Further, these containers can only be stacked up to four containers high using the adapters.

There are also domestic 53 foot containers that are used for trailers and trains. However, they do not provide the structural support required for stacking and racking the containers on a vessel at a 53 foot position. Containers that are placed on vessels need to be structurally strong enough to endure the rigors of ocean transport and withstand the forces exerted from other containers stacked on top. Containers that are used for domestic shipping have certain other requirements such as height and cubic capacity. In addition, containers need to comply with specifications of various standardizations and regulatory bodies such as International Organization for Standardization (ISO), Transit International Routier (TIR), Association of American Railroads (AAR) Standards, etc.

Therefore, there is a need for a universal hybrid container design that can be used for all means of transportation, and that also complies with the domestic and international shipping regulations. Embodiments of the invention solve these and other problems, individually and collectively.

BRIEF SUMMARY

Embodiments of the invention are directed to shipping containers and methods of stacking shipping containers.

One embodiment of the invention is directed to a shipping container forming a rectangular box shape, comprising a pair of side walls, a front wall and a rear wall coupled to the pair of side walls, a top wall coupled to the side walls and the rear walls, a bottom wall coupled to the side walls and the rear walls. The side walls, the front wall, the rear wall and the top wall form top corners. The sides walls, the front wall, the rear wall and the bottom wall form bottom corners. The shipping container further comprises a set of top corner fitting elements disposed at the top corners of the shipping container, each top corner fitting element having an outer aperture, and a set of bottom corner fitting elements disposed at the bottom corners of the shipping container, each bottom corner fitting element having an outer aperture.

Another embodiment of the invention is directed to a stack of shipping containers comprising a first shipping container comprising a first set of top corner fitting elements disposed at the top corners of the first shipping container, each top corner fitting element having an outer aperture, and a first set of bottom corner fitting elements disposed at bottom corners of the first shipping container, each bottom corner fitting elements having an outer aperture. The stack of shipping containers further comprising a second shipping container comprising a second set of top corner fitting elements disposed at the top corners of the second shipping container, each top corner fitting element having an outer aperture, and a set of bottom corner fitting elements disposed at bottom corners of the second shipping container, each bottom corner fitting elements having an outer aperture.

Another embodiment of the invention is directed to a method of stacking shipping containers, comprising obtaining a first shipping container, wherein the first shipping container comprises a set of top corner fitting elements disposed at the top corners of the first shipping container, each top corner fitting element having an outer aperture. The method further comprising, placing, using a mechanical device, a second shipping container on top of the first shipping container, wherein the second shipping container comprises a set of bottom corner fitting elements disposed at the bottom corners of the second shipping container, each bottom corner fitting element having an outer aperture. The method further comprising manipulating an attachment device to connect the first shipping container and the second shipping container using the outer aperture of each top corner fitting element of the first shipping container and the outer aperture of each bottom corner fitting element of the second shipping container.

These and other embodiments of the invention are described in further detail below.

DETAILED DESCRIPTION OF THE INVENTION

A universal hybrid container that can be used for vessels, and also trains and trailers, can be structurally strong enough to allow for multiple stacking, yet light enough for marine transportation. Embodiments of the invention describe a universal hybrid container comprising various modifications to a 53 foot container that is used for trains, trailers (domestic 53 foot version) or vessels (ocean 53 foot version). A 53 foot container is a shipping container that is approximately 53 feet in length. These modifications allow 53 foot shipping containers to be stacked directly on top of each other for ocean transport by utilizing corner fitting elements disposed on the corners of the shipping containers that contain outer apertures. This in turn allows more containers to be stacked (e.g., up to seven high versus four high) and eliminates the need for costly adapters. Moreover, semi-automatic twist locks can be used to secure the containers to each other instead of more costly locking devices such as fully automatic twist locks. These and other modifications will be described in further detail below with references to FIGS. 1-16.

Figure 1A:
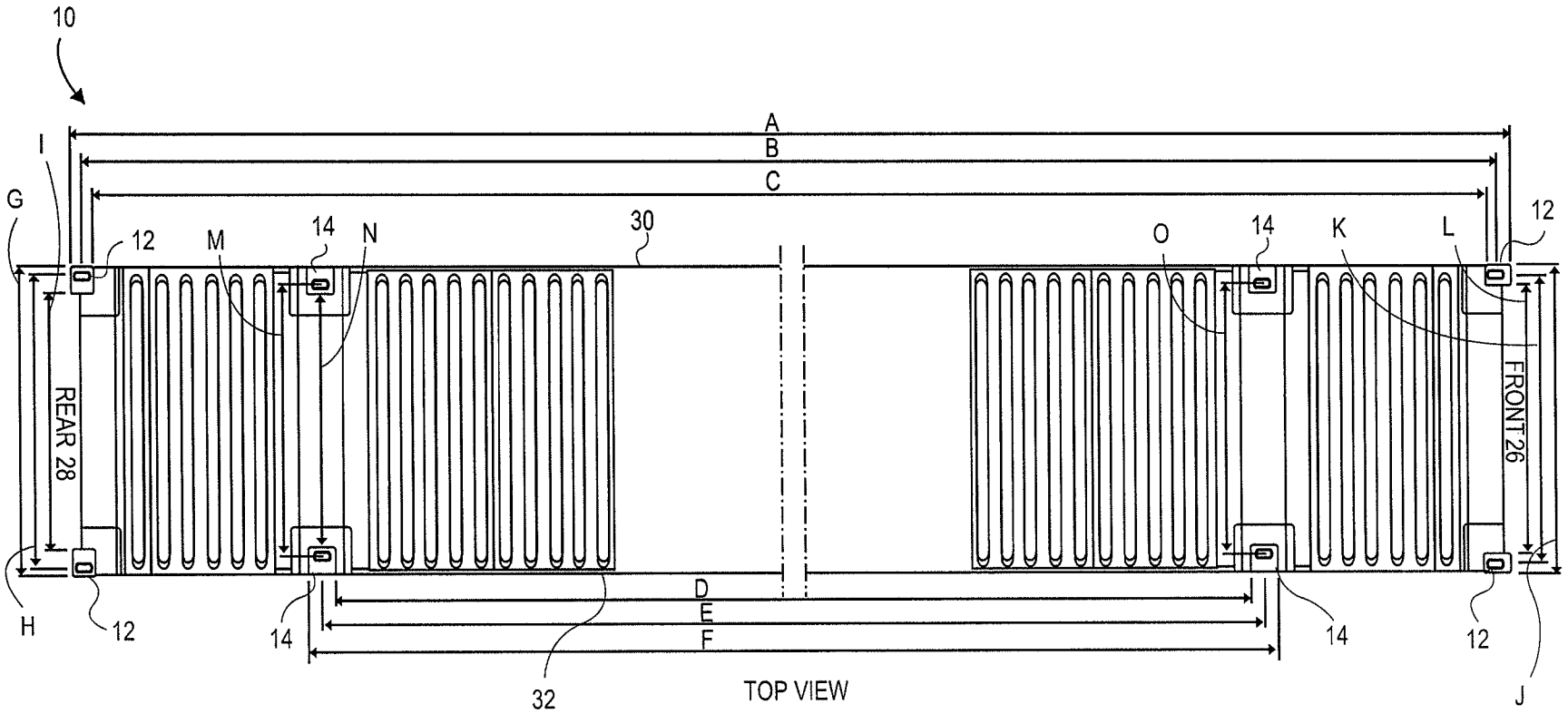
FIG. 1A shows a top view of a container according to an embodiment of the invention.
Figure 1B:
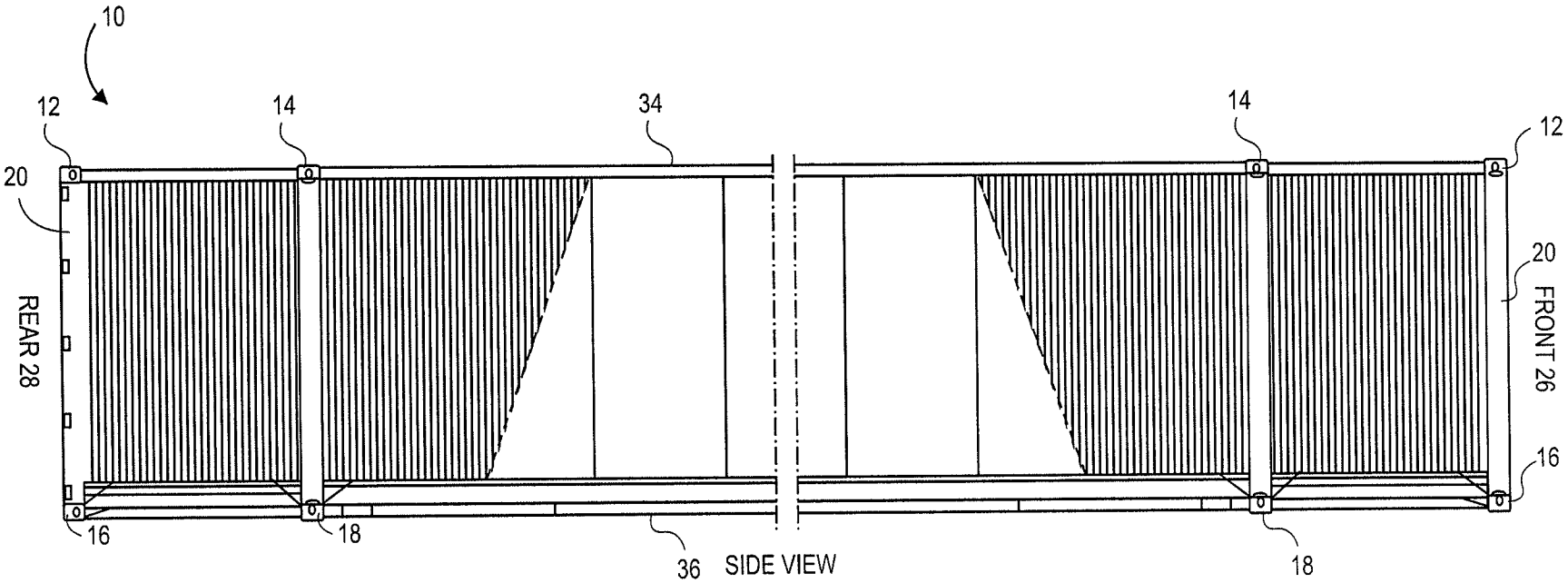
FIG. 1B shows a side view of a container according to an embodiment of the invention.
Figure 1C:
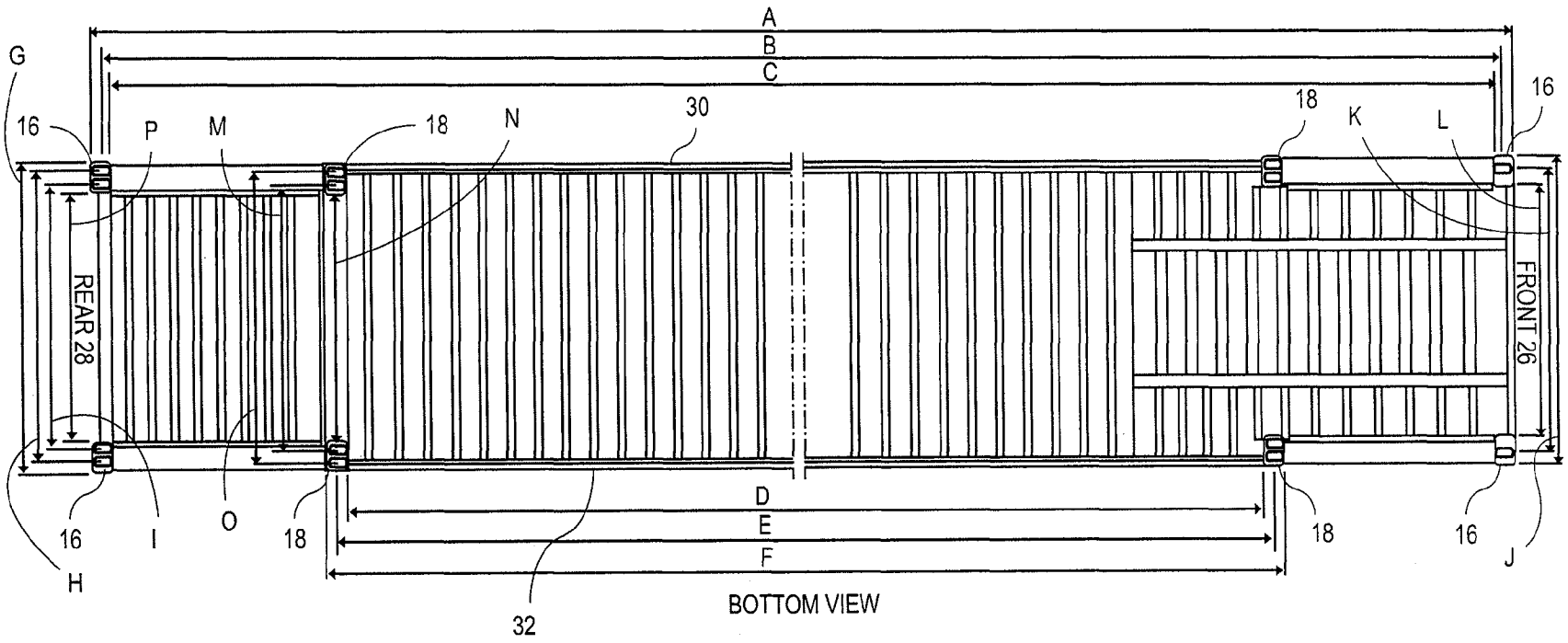
FIG. 1C shows a bottom view of a container according to an embodiment of the invention.
Figure 1E:
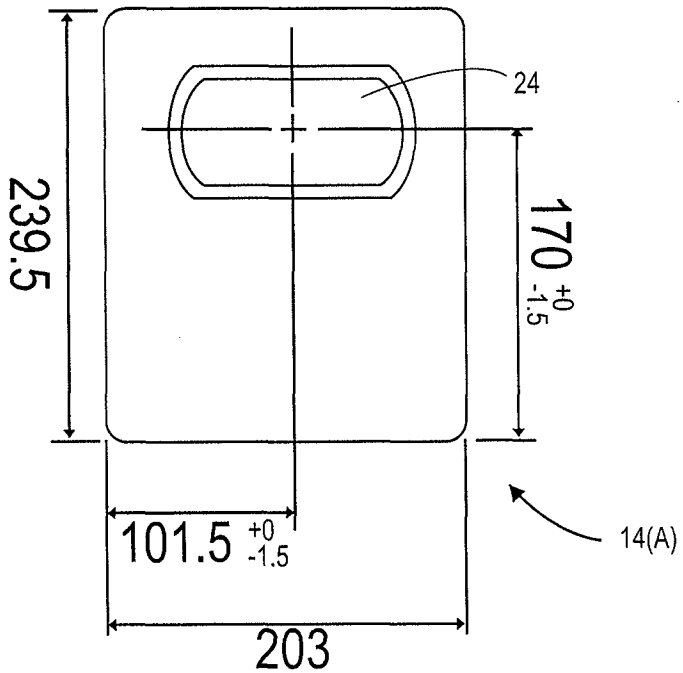
FIGS. 1D-1J show exemplary dimensions for various fitting elements.
Figure 1D:
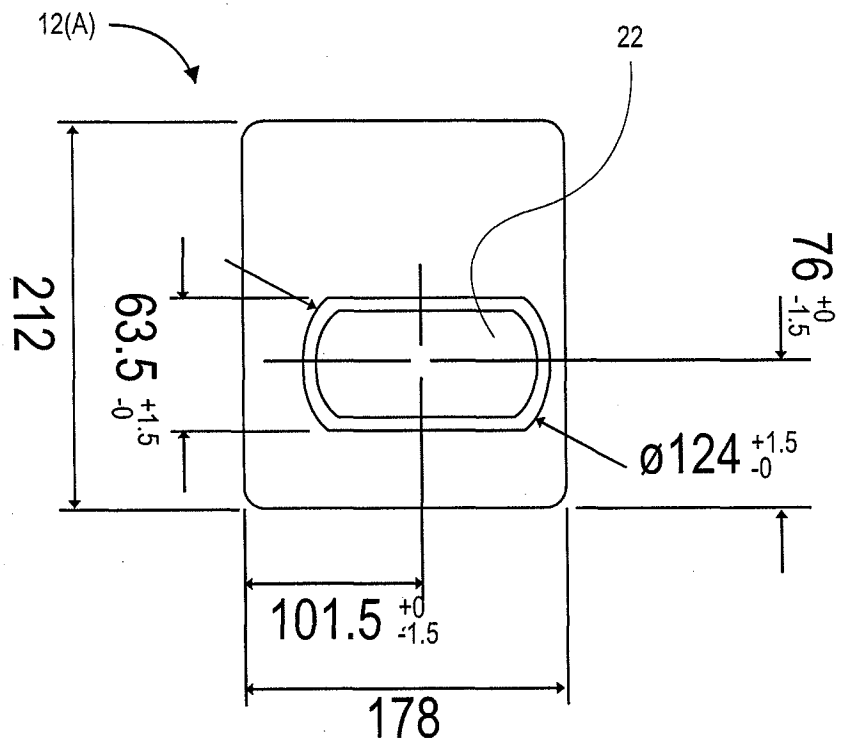
Figure 1G:
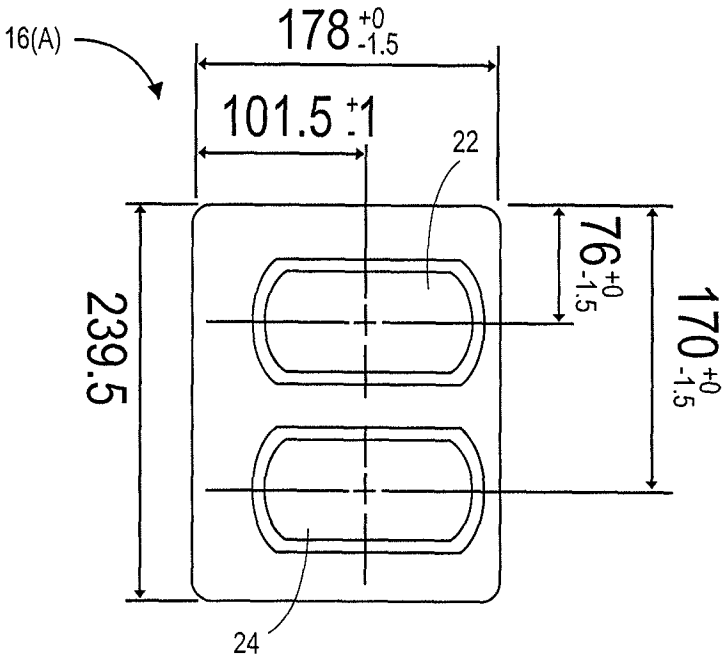
Figure 1F:
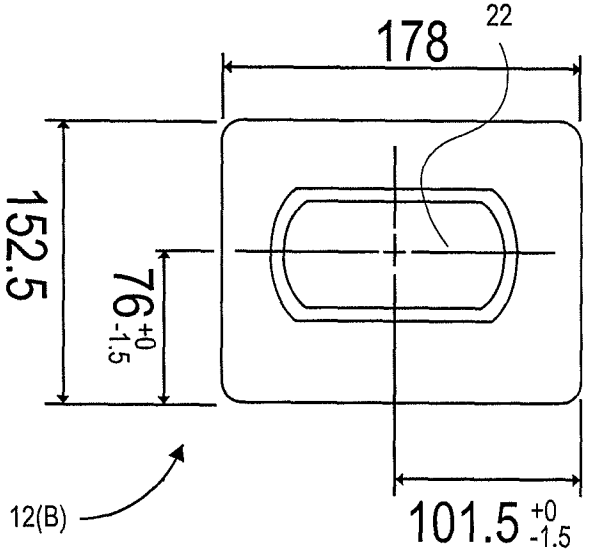
Figure 1J:
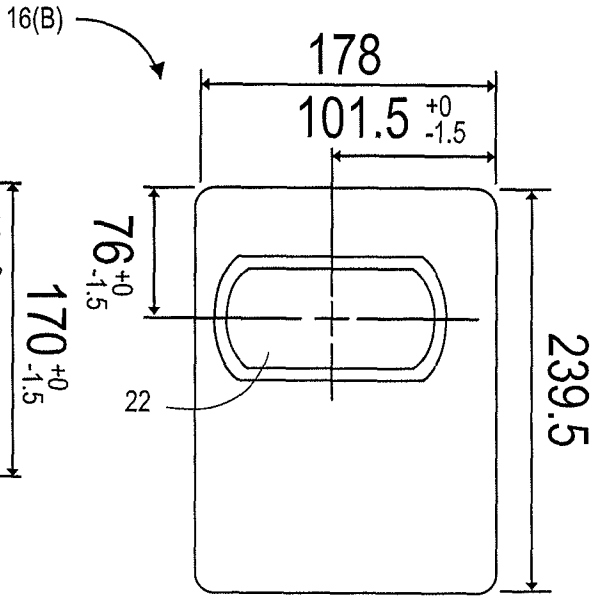
Figure 1I:
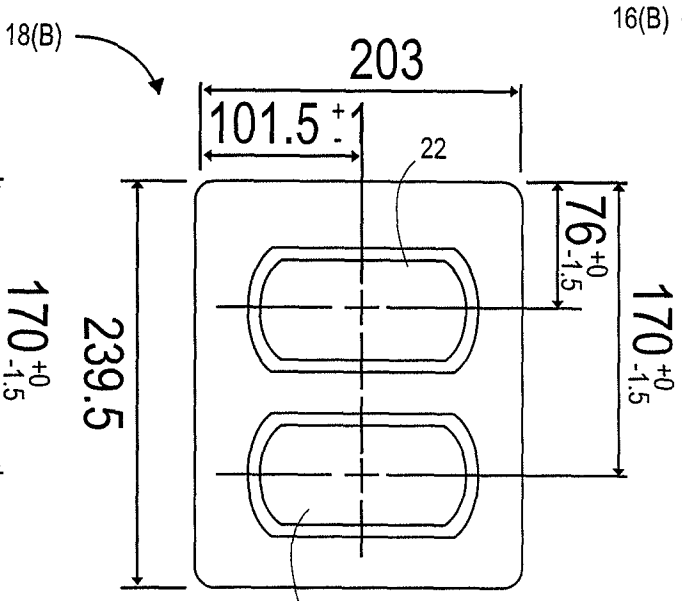
Figure 1H:
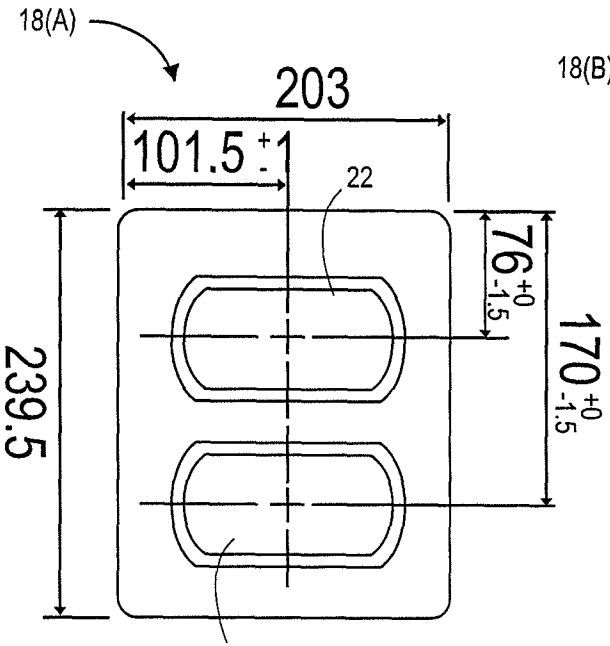

FIGS. 1A-1C show different views of a shipping container 10 according to an embodiment of the invention. Exemplary external dimensions for the shipping container 10 shown in FIGS. 1A-1C may be as follows: Length 16,154 (+0, −10) mm or 53'-0" (+0", −⅜"), Width 2,600 (+0, −5) mm or 8'-6⅜" (+0", −3/16"), and Height 2,908 (+0, −5) mm or 9'-6½" (+0", −3/16"). Exemplary internal dimensions may be as follows: Length 15,995 mm or 52'-5¾", Width (between panels) 2,514 mm or 8'-3", and Height 2,759 mm or 9' ⅝". Exemplary door opening dimensions may be as follows: Width 2.489 mm or 8'-2" and Height 2,718 mm or 8'-11".

FIG. 1A shows a top wall view of the shipping container 10. The shipping container 10 has a front wall 26, a rear wall 28, and a pair of side walls (e.g., a first side wall 30 and a second side wall 32). The walls of the shipping container may be corrugated. The shipping container 10 has a set (e.g., four) of top corner fitting elements 12. Each top corner fitting elements has a outer aperture 22 as shown in the enlarged view 12(A) of FIGS. 1D and 12(B) of FIG. 1F of the top corner fitting element 12. The aperture 22 is called an outer aperture because it is located towards the outer part of the fitting element (e.g., closer to the side of the container 10). The shipping container 10 may also have a set (e.g., four) of top intermediate fitting elements 14. Each top intermediate fitting element 14 may be located approximately 13 feet from each corner fitting element 12 (e.g., at a 40 foot position). Each top intermediate fitting element 14 has an inner aperture 24 as shown in the enlarged view 14(A) of FIG. 1E of the top intermediate fitting element 14. In contrast to an outer aperture which is located at the outer part of the fitting element, an inner aperture is located towards the inner part of the fitting element (e.g., closer to the center of the container 10). For example, FIGS. 1A and 1C show how the distance between the outer apertures 22 of corner fitting elements 12 or 16 at one end of the container (e.g., the rear end or the front end) is dimension H or K (e.g., 2448 mm) versus the distance between the inner apertures 24 of intermediate fitting elements 14 or 18 is dimension M and O in FIG. 1A and dimension M in FIG. 1C (e.g., 2260 mm). In general, these apertures may be used for a variety of purposes such as loading the container on a shipping vehicle (e.g., vessel, trailer, train), securing the container to other containers, lifting and moving the containers, etc.

Exemplary dimensions for the various letters in FIG. 1A may be as follows. A=16154 mm, B=15951 mm, C=15798 mm, D=11786 mm, E=11989 mm, F=12192 mm, G=2600 mm, H=2448 mm, I=2176 mm, J=2600 mm, K=2448 mm, L=2295 mm, M=2260 mm, N=2121 mm, and O=2260 mm. As shown, the width of the container can be greater than 16100 mm and less than 16200 mm.

FIG. 1B shows a side wall view of shipping container 10 (e.g., a first side or a second side). The shipping container 10 also has a front wall 26, a rear wall 28, a top wall 34, and a bottom wall 36. The shipping container 10 has a set (e.g., four) of top corner fitting elements 12 and a set (e.g., four) of bottom corner fitting elements 16. Two of each can be seen in FIG. 1B. The shipping container 10 has a set (e.g., four) of top intermediate fitting elements 14 and a set (e.g., four) of bottom intermediate fitting elements 18. Two of each can be seen in FIG. 1B. Each top intermediate fitting element 14 may be located approximately 13 feet from each top corner fitting element 12 (e.g., at a 40 foot position). Each bottom intermediate fitting element 18 may be located approximately 13 feet from each bottom corner fitting element 16 (e.g., at a 40 foot position). The shipping container 10 has vertical support frames 20. Each vertical support frames 20 is disposed between each top corner fitting element 12 and each bottom corner fitting element 16. Only two vertical support frames 20 can be viewed from the side view perspective of this figure. There are also two vertical support frames 20 on the other side of container 10. The outer apertures 22 of corner fitting elements 12 and 16 are located above or below each of the vertical support frames 20.

A vertical support frame may include a solid bar or solid region that is thicker than the walls of the container 10. For example, a vertical support frame may be made of a 4.5 mm thick section steel pressing to ensure suitable strength. The vertical support frame may be made of extra high strength steel (700 Mpa). In some embodiments, the vertical support frame 20 may be connected to the top and bottom corner fittings and to the top header and bottom sill. In some embodiments the vertical support frame may be constructed from an inner part of channel shaped steel and an outer part of steel pressing, welded together to form a hollow section to ensure the door opening and suitable strength against the stacking and racking force. Five sets of hinge pin lugs may be welded to each outer part of the vertical support frame 20. Exemplary dimensions for the inner part is 122×46.5×6.0 mm and for the outer part is 6.0 mm thick.

FIG. 1C shows a bottom wall view of shipping container 10. The shipping container 10 has a front wall 26, a rear wall 28, a top wall (not shown), a pair of side walls (e.g., a first side wall 30 and a second side wall 32). The shipping container 10 has a set (e.g., four) of bottom corner fitting elements 16 and a set (e.g., four) of bottom intermediate fitting elements 18. Each intermediate fitting element 18 may be located approximately 13 feet from each corner fitting element 16 (e.g., at a 40 foot position). The bottom corner fitting elements 16 located on the rear wall 28 of the shipping container 10 each have an inner aperture 24 and an outer aperture 22 as shown in the enlarged view 16(A) of FIG. 1G of the bottom corner fitting elements 16. The bottom intermediate fitting elements 18 each have an inner aperture 24 and an outer aperture 22 as shown in the enlarged view 18(A) of FIGS. 1H and 18(B) of FIG. 1I of the bottom intermediate fitting elements 18. The aperture 22 is called an outer aperture because it is located towards the outer part of the fitting element (e.g., closer to the side of the container 10). In contrast to an outer aperture 22 which is located at the outer part of the fitting element, an inner aperture 24 is located towards the inner part of the fitting element (e.g., closer to the center of the container 10). In general, these apertures may be used for a variety of purposes such as securing the container to the shipping vehicle (e.g., vessel, trailer, train), securing the container to other containers, lifting and moving the containers, etc.

Typically, dual apertures as shown in FIG. 1C are only allowed at the bottom of the container and not at the top of the container (see FIG. 1A for contrast). There is a common seam between the two apertures that is weak relative to other portions of the fitting elements. Containers are typically lifted from the top aperture of the intermediate fitting element (e.g., at a 40 foot position) to move the container on and off a vessel. Thus, dual apertures are not typically located at the top of the container because it will effect the lifting capability of the container.

Exemplary dimensions for the various letters in FIG. 1C may be as follows. A=16154 mm, B=15951 mm, C=15798 mm, D=11786 mm, E=11989 mm, F=12192 mm, G=2600 mm, H=2448 mm, I=2260 mm, J=2600 mm, K=2448 mm, L=2121 mm, M=2260 mm, N=2121 mm, O=2148 mm, and P=2121 mm.

FIGS. 1D-1J show exemplary dimensions for enlarged views of various fitting elements from FIGS. 1A and 1B.

Figure 2:
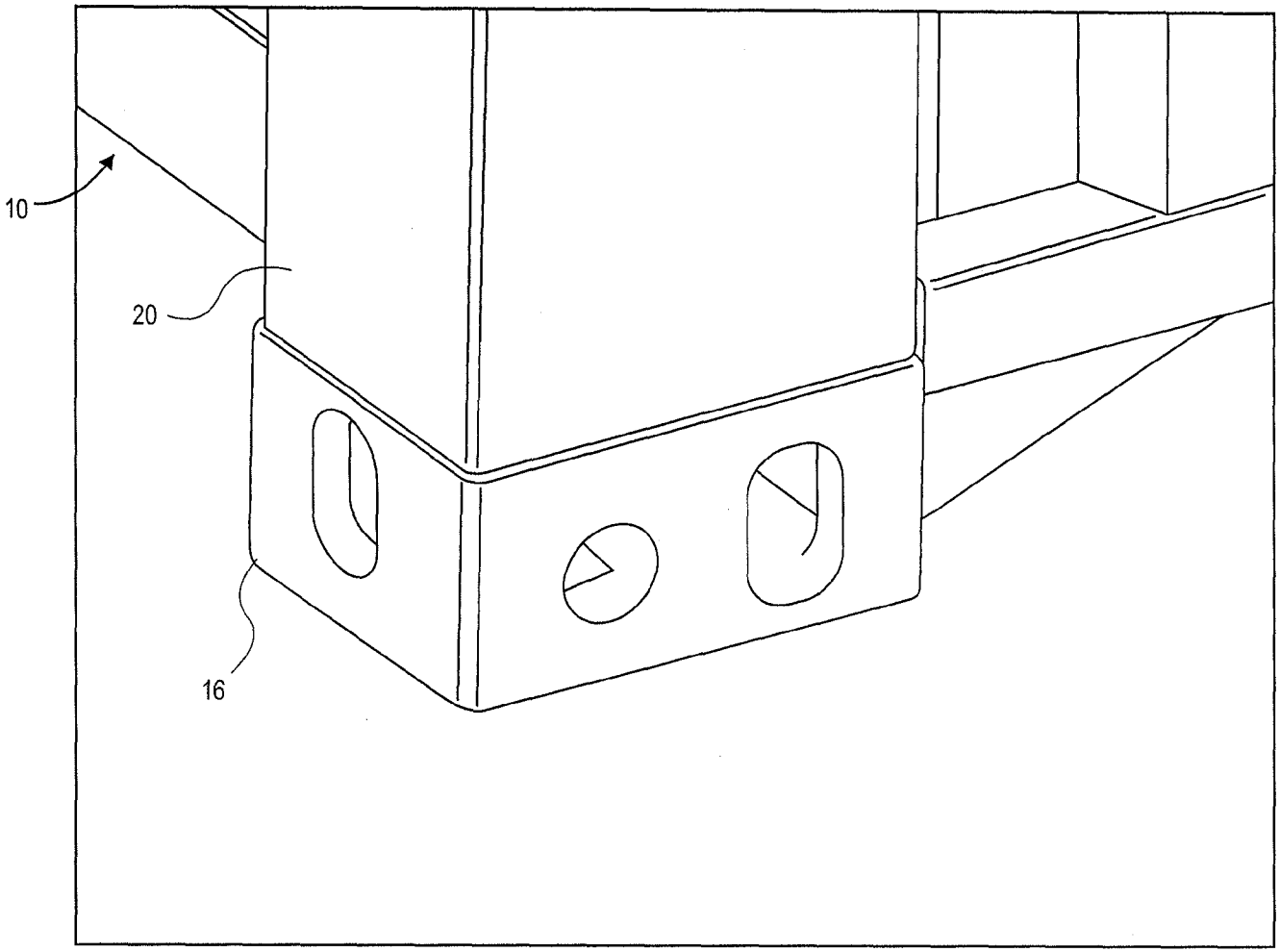
FIG. 2. shows a front bottom corner fitting element according to an embodiment of the invention.

FIG. 2 shows an enlarged view of a front bottom corner fitting element 16 of container 10. As shown, the front bottom corner fitting element 16 is coupled with a vertical support frame 20. Three miscellaneous apertures are shown which may be used for a variety of purposes such as for loading the container on a shipping vehicle (e.g., vessel, trailer, train), lifting and moving the containers, etc.

Figure 3:
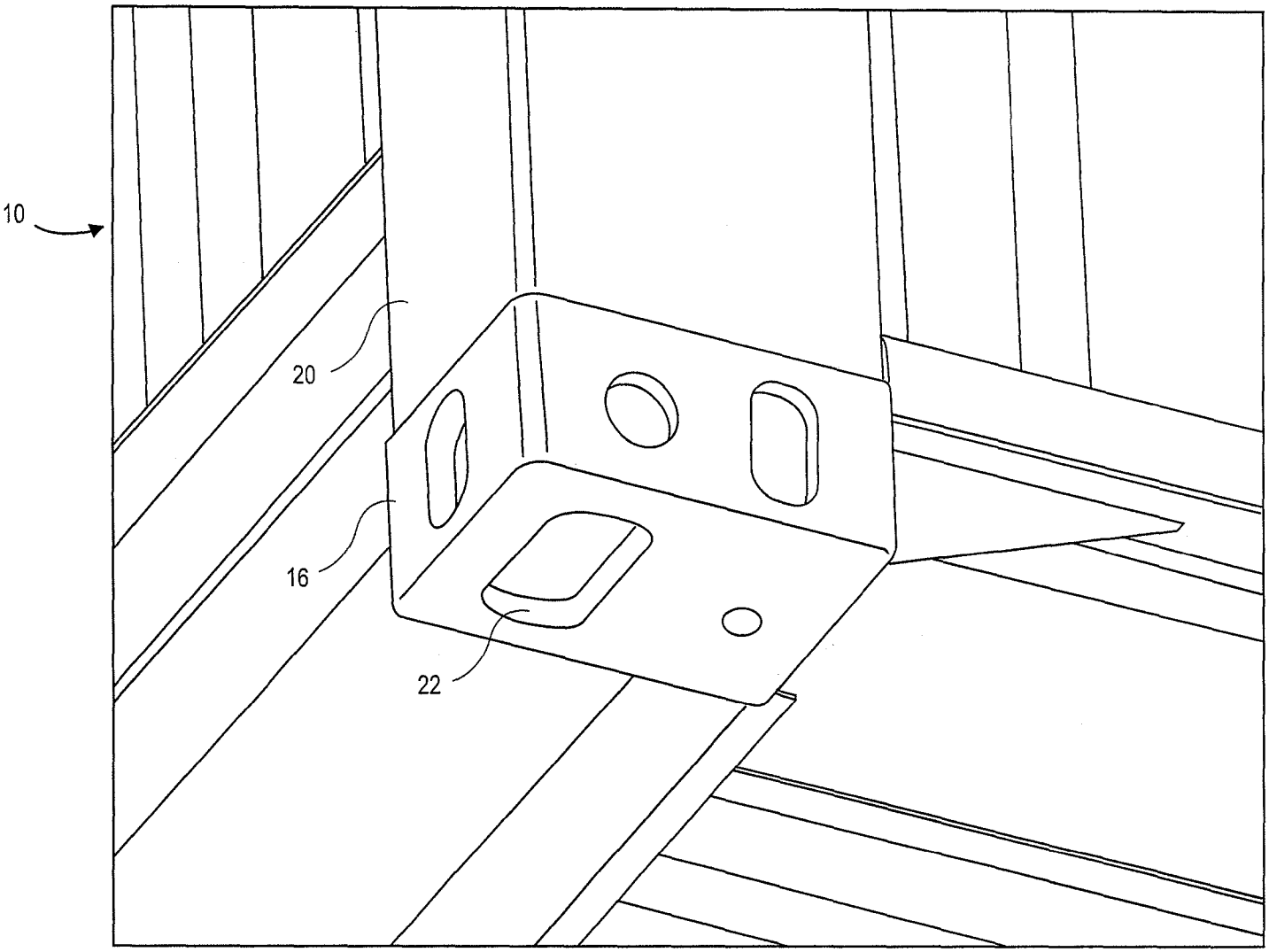
FIG. 3 shows a front bottom corner fitting element according to an embodiment of the invention.

FIG. 3 shows another enlarged view of a front bottom corner fitting element 16 of container 10. As shown, the front bottom corner fitting element 16 is coupled with a vertical support frame 20. Also shown is an outer aperture 22. This outer aperture 22 is used to secure the container 10 to another container for transport on a vessel (for example). An attachment device may be used to secure the containers together using the outer aperture 22. Some examples of an attachment device include a semi-automatic twist lock and a fully automatic twist lock. Preferably, a semi-automatic twist lock is used to secure the containers together using the outer aperture 22 because it is less costly than a fully automatic twist lock. Semi-automatic twist locks can require some human intervention and can be used with the outer apertures of the corner fitting elements because they are in a position accessible from the outside of the container.

As can be seen in FIG. 3, the outer aperture 22 is located underneath the vertical support frame 20. Thus, when the attachment device is used to secure containers together using outer aperture 22, the strength of the containers is reinforced by the vertical support frames on each container. This provides additional strength and support to allow more containers to be stacked on top of each other. In some embodiments of the invention, containers may be stacked seven containers high. Other apertures are shown in this figure which may be used for a variety of purposes such as for loading the container on a shipping vehicle (e.g., vessel, trailer, train), lifting and moving the containers, etc.

Figure 4:
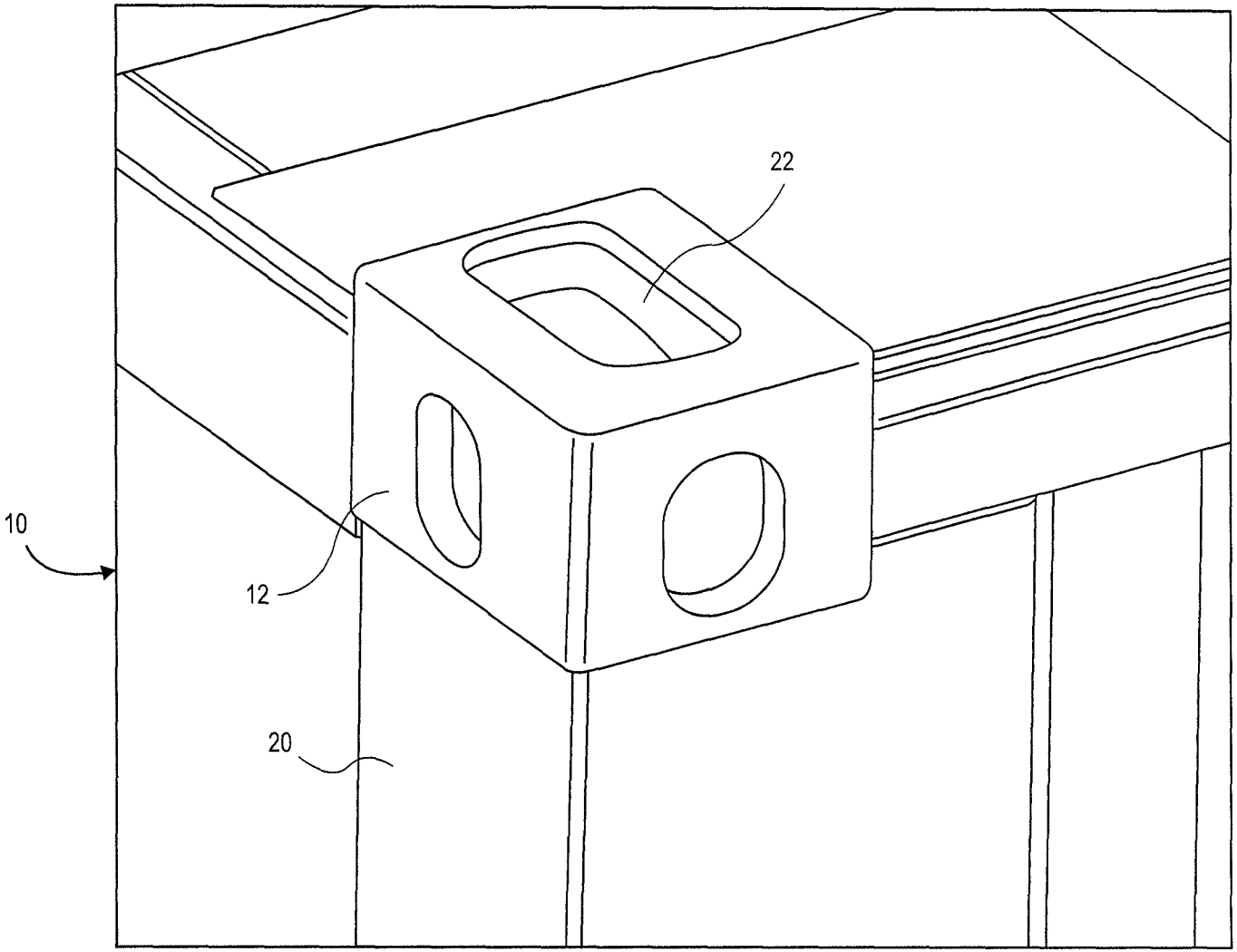
FIG. 4 shows a front top corner fitting element according to an embodiment of the invention.

FIG. 4 shows an enlarged view of a front top corner fitting element 12 of container 10. As shown, the front top corner fitting element 12 is coupled with a vertical support frame 20. Also shown is an outer aperture 22. This outer aperture 22 is used to secure the container 10 to another container for transport on a vessel (for example). An attachment device may be used to secure the containers together using the outer aperture 22. Some examples of an attachment device include a semi-automatic twist lock and a fully automatic twist lock. Preferably, a semi-automatic twist lock is used to secure the containers together using the outer aperture 22 because it is less costly than a fully automatic twist lock.

As can be seen in FIG. 4, the outer aperture 22 is located above the vertical support frame 20. This provides additional strength and support to allow more containers to be stacked on top of each other, as described above. Other apertures are shown in this figure which may be used for a variety of purposes such as for loading the container on a shipping vehicle (e.g., vessel, trailer, train), lifting and moving the container, etc.

Figure 5:
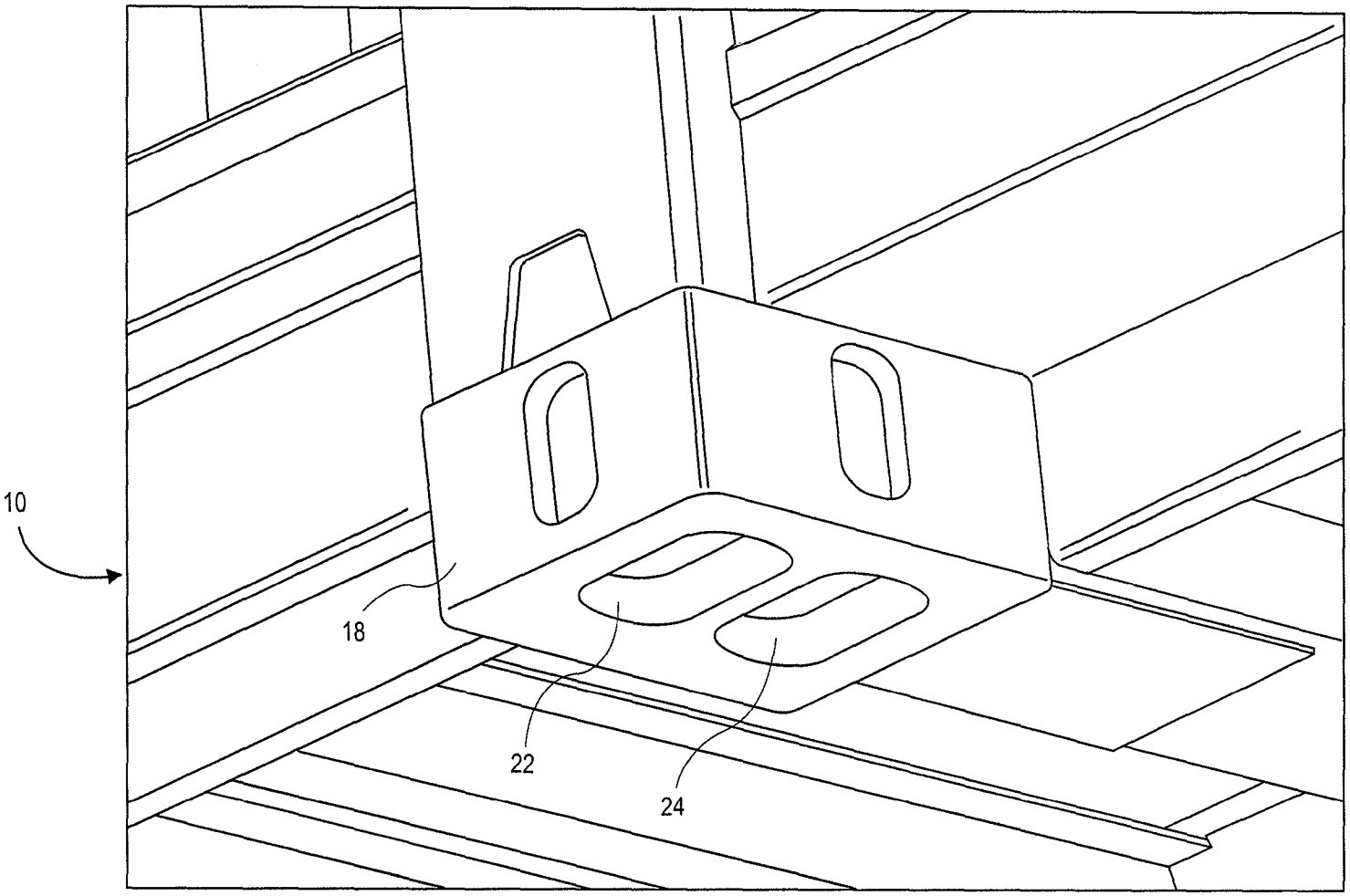
FIG. 5 shows a bottom intermediate fitting element according to an embodiment of the invention.

FIG. 5 shows an enlarged view of a bottom intermediate fitting element 18 of container 10. The bottom intermediate fitting element 18 has an outer aperture 22 and an inner aperture 24. The inner aperture 24 may be used to secure the container 10 to another container for transport on a vessel (for example). For example, an attachment device such as a fully automatic twist lock may be used to secure the containers together using the inner aperture 24. A semi-automatic twist lock typically cannot be used to secure the containers using the inner aperture 24 because some human intervention can be required to activate the semi-automatic twist lock and the inner aperture 24 is not accessible from the outside of the container 10. The outer aperture 22 and other apertures shown in this figure may be used for a variety of purposes such as for loading the container on a shipping vehicle (e.g., vessel, trailer, train), lifting and moving the containers, etc.

Figure 6:
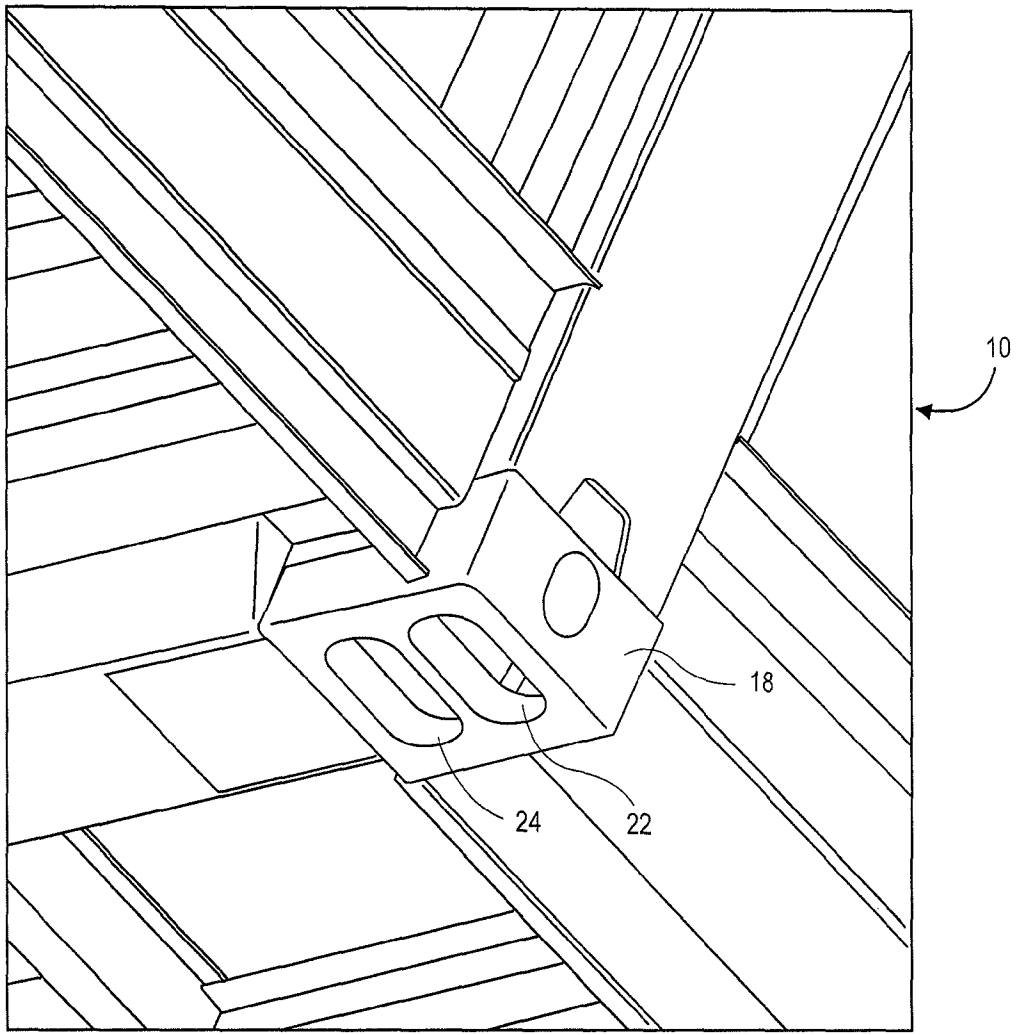
FIG. 6 shows a bottom intermediate fitting element according to an embodiment of the invention.

FIG. 6 shows another enlarged view of a bottom intermediate fitting element 18 of container 10. The bottom intermediate fitting element 18 has an outer aperture 22 and an inner aperture 24. The inner aperture 24 may be used to secure the container 10 to another container for transport on a vessel (for example). For example, an attachment device such as a fully automatic twist lock may be used to secure the containers together using the inner aperture 24. A semi-automatic twist lock typically cannot be used to secure the containers using the inner aperture 24 because some human intervention can be required to activate the semi-automatic twist lock and the inner aperture is not accessible from the outside of the container. Moreover, securing containers using the inner aperture 22 of an intermediate fitting element 18 is not as secure as securing containers using an outer aperture of a corner fitting element according to embodiments of the invention. The reason for this is because the inner aperture of the intermediate fitting element is not secured to any vertical support frame as is the case with the outer aperture of the corner fitting element. Thus, when the containers are secured at this position the support structure is very weak without the reinforcement on the container and so the containers can only be stacked three or four containers high. The outer aperture 22 and other apertures shown in this figure may be used for a variety of purposes such as for loading the container on a shipping vehicle (e.g., vessel, trailer, train), lifting and moving the containers, etc.

Figure 7:
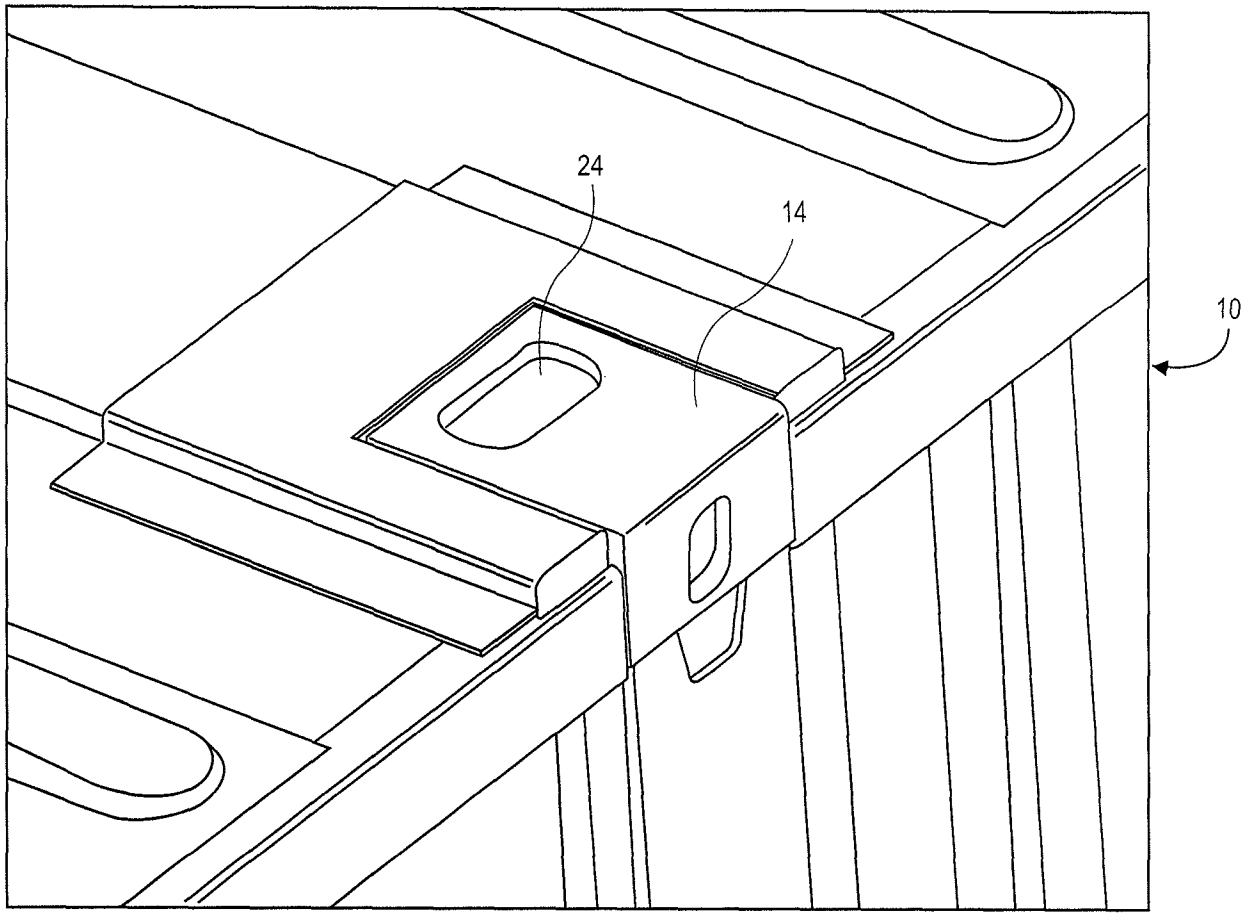
FIG. 7 shows a top intermediate fitting element according to an embodiment of the invention.

FIG. 7 shows an enlarged view of a top intermediate fitting element 14 of container 10. The top intermediate fitting element 14 is recessed within the top wall 34 and cooperatively structured with the top wall 34. The top intermediate fitting element 14 has an inner aperture 24. The inner aperture 24 may be used to secure the container 10 to another container for transport on a vessel (for example). For example, an attachment device such as a fully automatic twist lock may be used to secure the containers together using the inner aperture 24. As explained above, a semi-automatic twist lock typically cannot be used to secure the containers together using inner aperture 24. As also described in detail above, securing a container 10 using an attachment device and the inner aperture at this position (of an intermediate fitting element) can provide for a weak support structure and only allows containers to be stacked three or four containers high. Other apertures are shown in this figure which may be used for a variety of purposes such as for loading the container on a shipping vehicle (e.g., vessel, trailer, train), lifting and moving the containers, etc.

Figure 8:
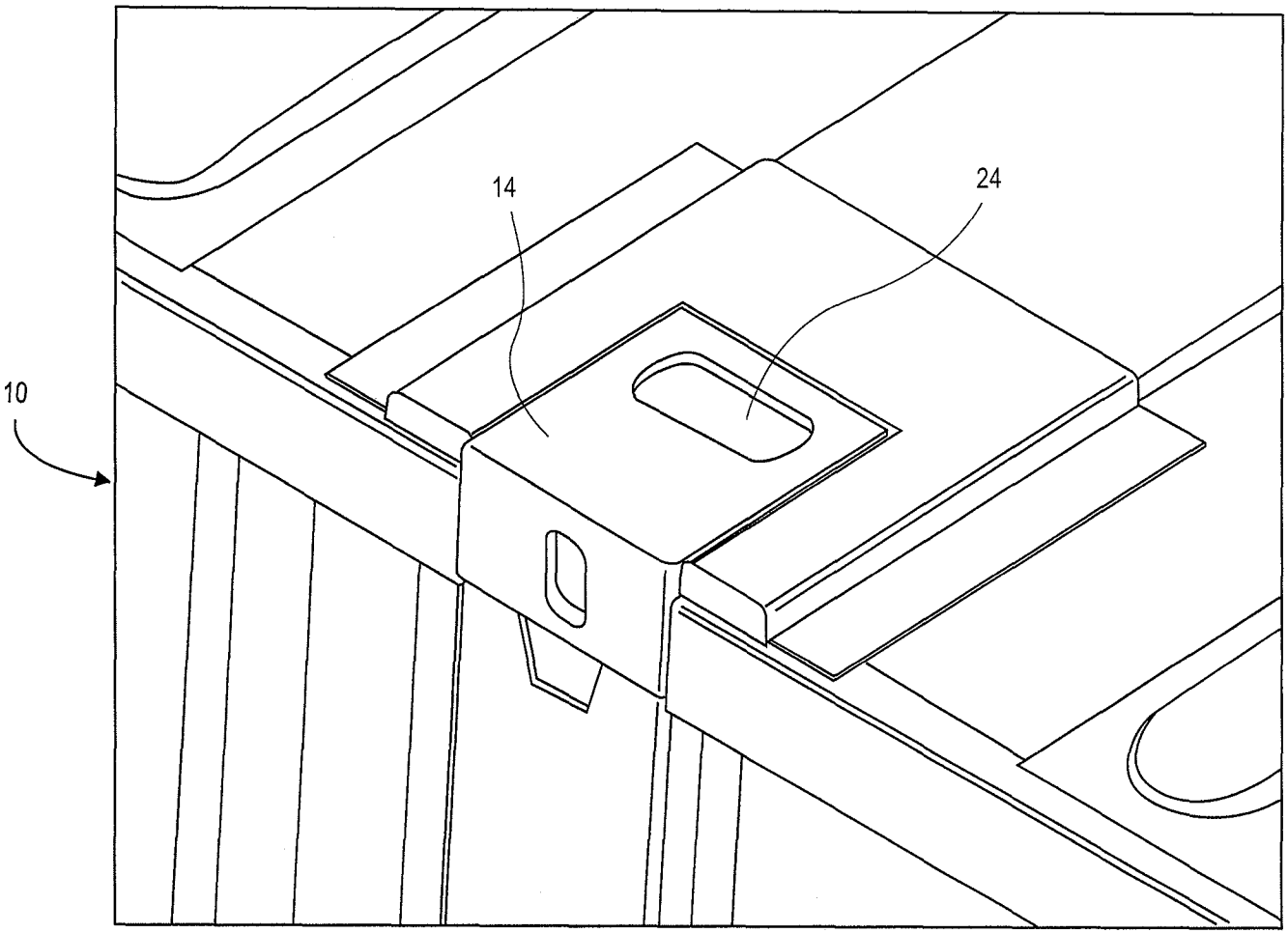
FIG. 8 shows a top intermediate fitting element according to an embodiment of the invention.

FIG. 8 shows another enlarged view of a top intermediate fitting element 14 of container. The top intermediate fitting element 14 is recessed within the top wall 34 and cooperatively structured with the top wall 34. The top intermediate fitting element 14 has an inner aperture 24. The inner aperture 24 may be used to secure the container 10 to another container for transport on a vessel (for example). A fully automatic twist lock may be used to secure the containers together using the inner aperture 24. As explained above a semi-automatic twist lock typically cannot be used to secure the containers together using inner aperture 24. As also described in detail above, securing a container 10 using an attachment device and the inner aperture at this position (of an intermediate fitting element) can provide for a weak support structure and only allows containers to be stacked three or four containers high. The other aperture shown in this figure may be used for a variety of purposes such as for loading the container on a shipping vehicle (e.g., vessel, trailer, train), lifting and moving the containers, etc.

Figure 9:
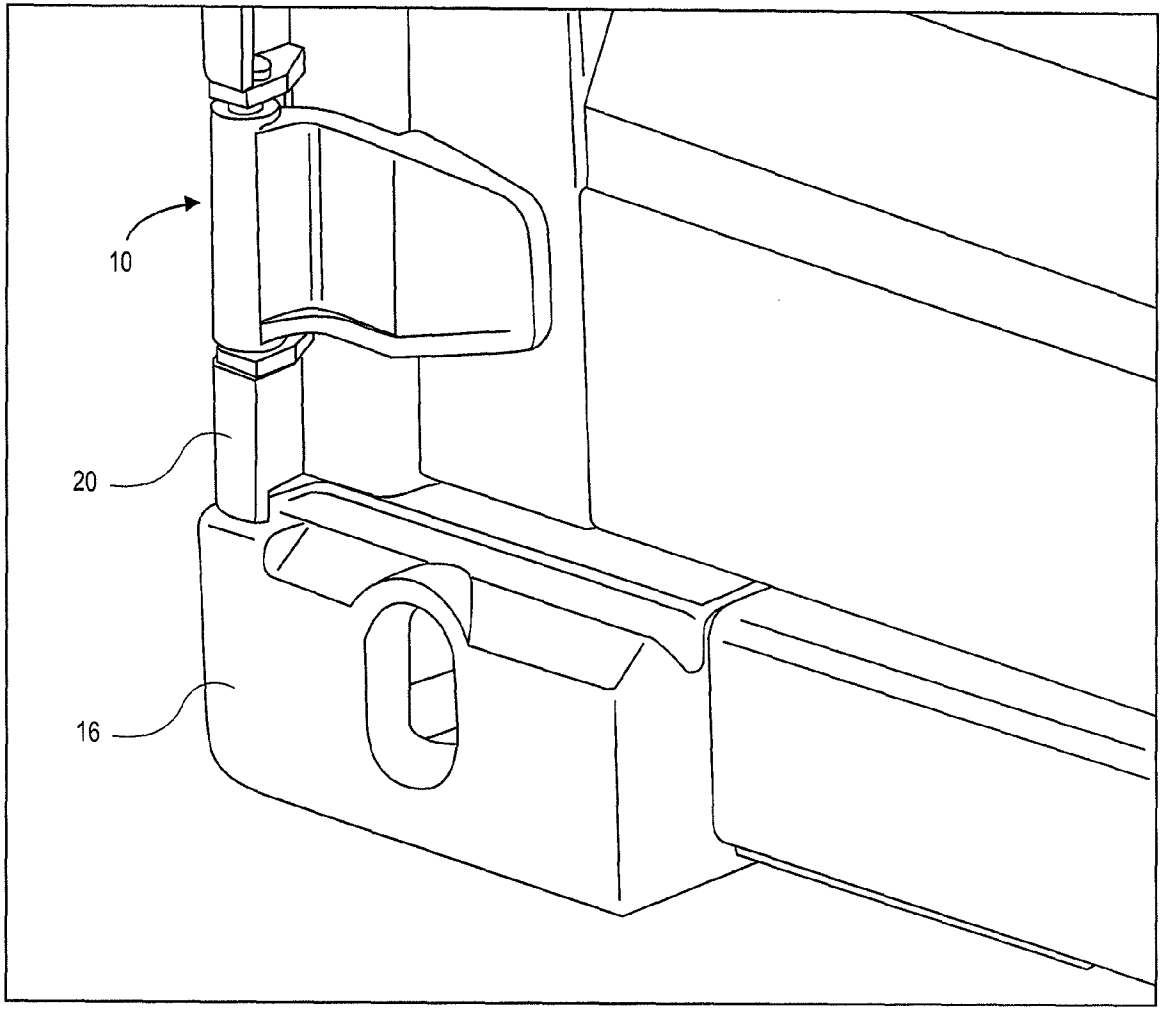
FIG. 9 shows a rear bottom corner fitting element according to an embodiment of the invention.

FIG. 9 shows an enlarged view of a rear bottom corner fitting element 16 of container 10 having. As shown, the rear bottom corner fitting element 16 is coupled with a vertical support frame 20. This provides additional strength and support to allow more containers to be stacked on top of each other, as described above. An aperture is shown which may be used for a variety of purposes such as for loading the container on a shipping vehicle (e.g., vessel, trailer, train), lifting and moving the containers, etc.

Figure 10:
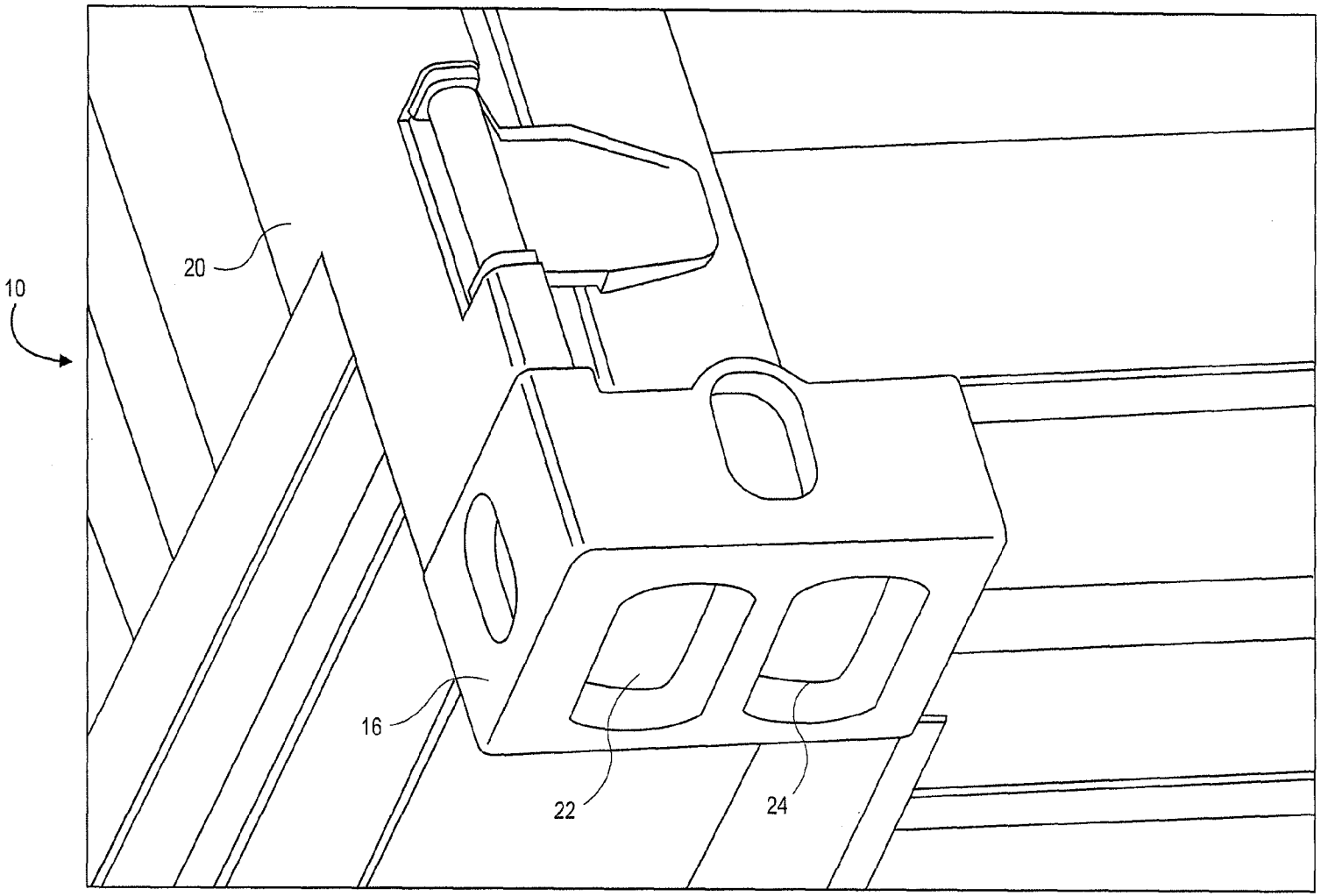
FIG. 10 shows a rear bottom corner fitting element according to an embodiment of the invention.

FIG. 10 shows another enlarged view of a rear bottom corner fitting element 16 of container 10. As shown, the rear bottom corner fitting element 16 is coupled with a vertical support frame 20. This provides additional strength and support to allow more containers to be stacked on top of each other, as described above. The rear bottom corner fitting element 16 has an outer aperture 22 and an inner aperture 24. The outer aperture 22 is used to secure the container 10 to another container for transport on a vessel (for example). An attachment device may be used to secure the containers together using the outer aperture 22. Some examples of an attachment device include a semi-automatic twist lock and a fully automatic twist lock. Preferably, a semi-automatic twist lock is used to secure the containers together using the outer aperture 22 because it is less costly than a fully automatic twist lock. The inner aperture 24 and other apertures shown in this figure may be used for a variety of purposes such as for loading the container on a shipping vehicle (e.g., vessel, trailer, train), lifting and moving the containers, etc.

Figure 11:
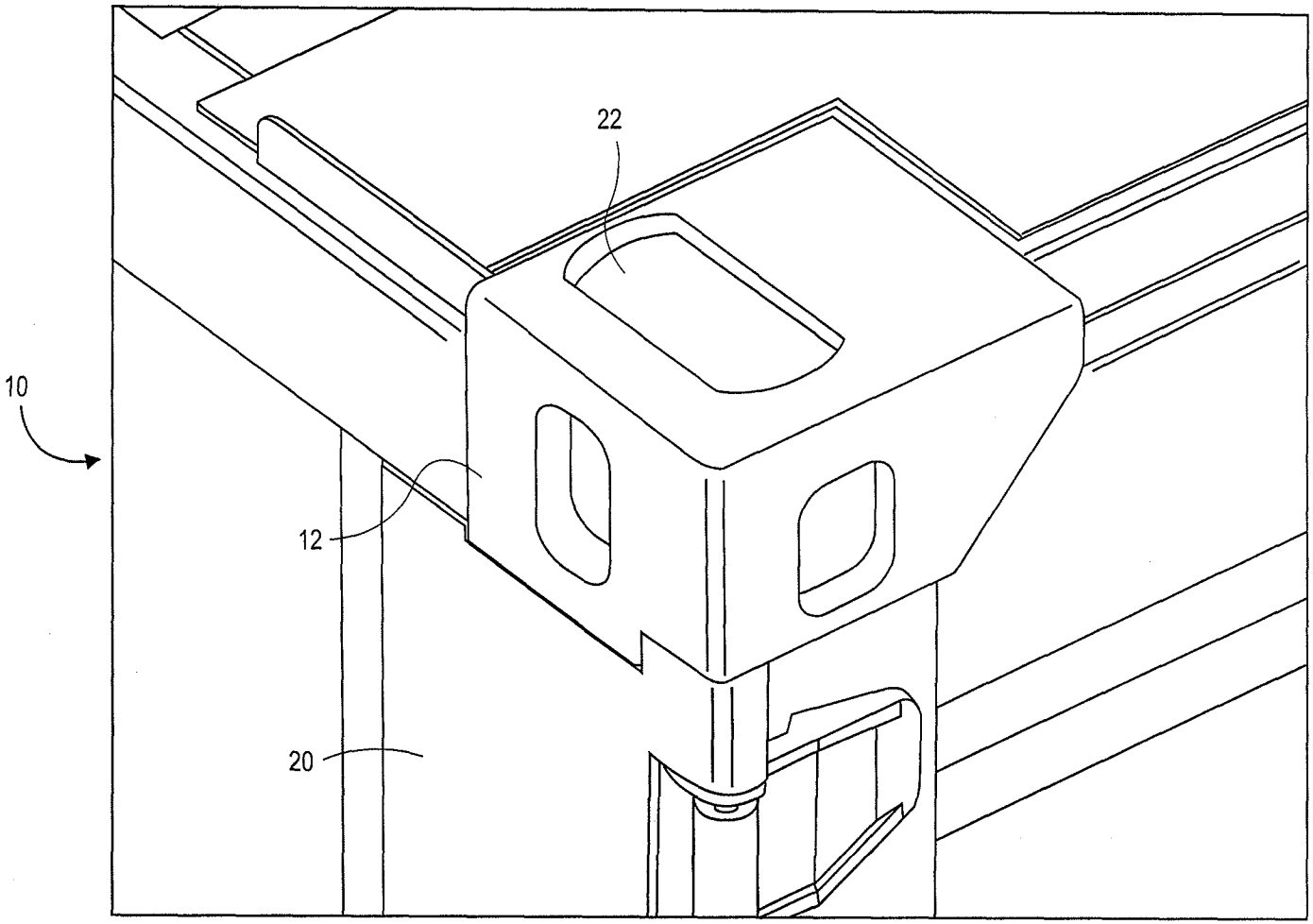
FIG. 11 shows a rear top corner fitting element according to an embodiment of the invention.

FIG. 11 shows an enlarged view of a rear top corner fitting element 12. As shown, the rear top corner fitting element 12 is coupled with a vertical support frame 20. This provides additional strength and support to allow more containers to be stacked on top of each other, as described above. The rear top corner fitting element 12 has an outer aperture 22. The outer aperture 22 may be used to secure the container 10 to another container for transport on a vessel (for example). An attachment device such as a semi-automatic twist lock may be used to secure the containers together using the outer aperture 22. Other apertures are shown in this figure which may be used for a variety of purposes such as for loading the container on a shipping vehicle (e.g., vessel, trailer, train), lifting and moving the containers, etc.

Figure 12:
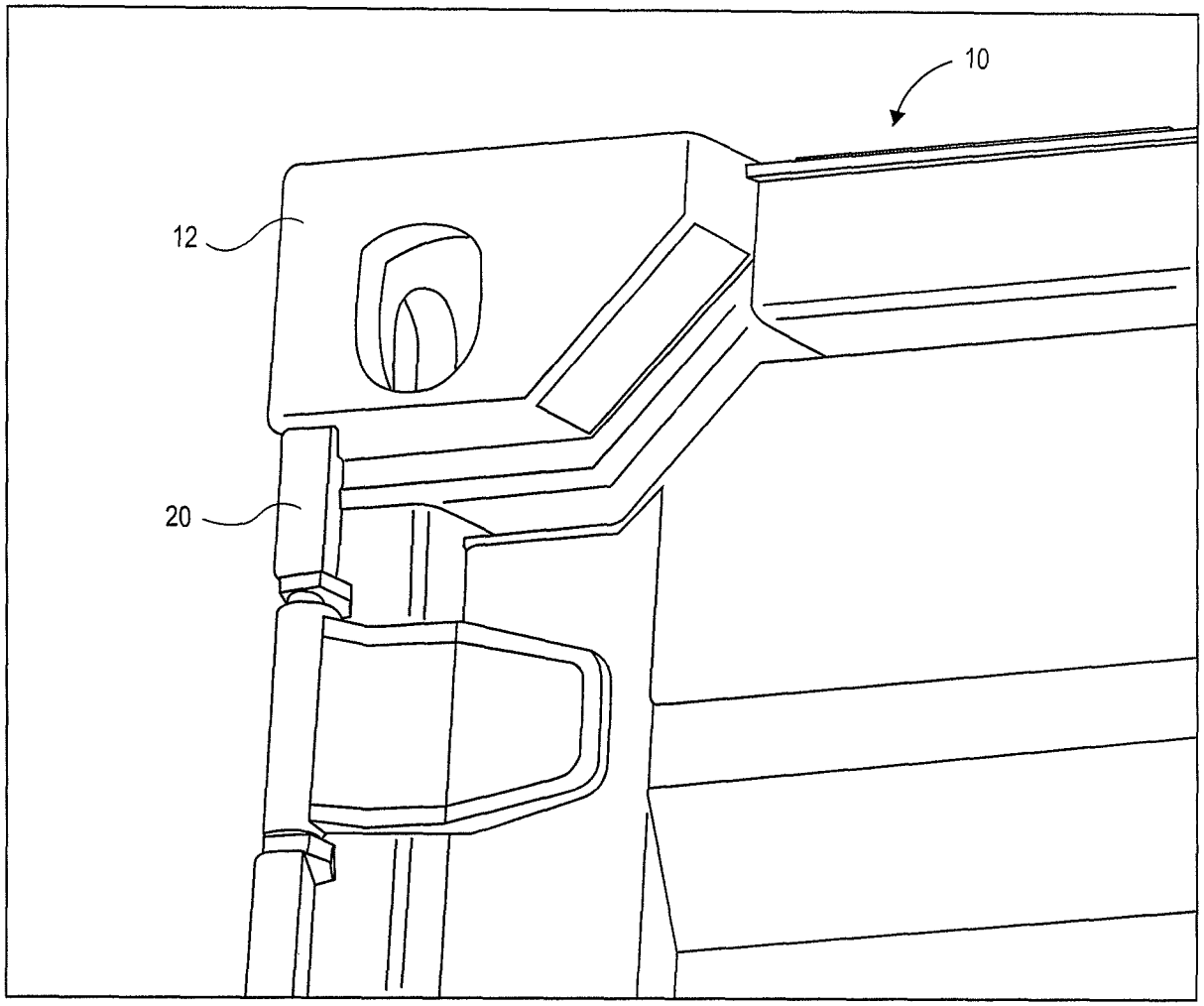
FIG. 12 shows a rear top corner fitting element according to an embodiment of the invention.

FIG. 12 shows another enlarged view of a rear top corner fitting element 12. As shown, the rear top corner fitting element 12 is coupled with a vertical support frame 20. This provides additional strength and support to allow more containers to be stacked on top of each other, as described above. The aperture shown in this figure may be used for a variety of purposes such as for loading the container on a shipping vehicle (e.g., vessel, trailer, train), lifting and moving the containers, etc.

Figure 13A:
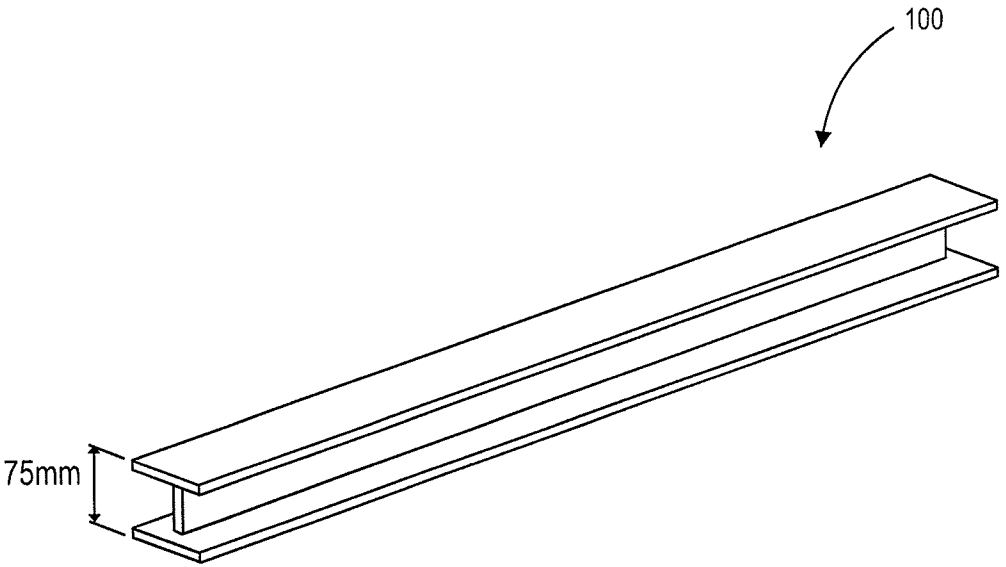
FIGS. 13(A)-13(B) show a cross member according to an embodiment of the invention.
Figure 13B:
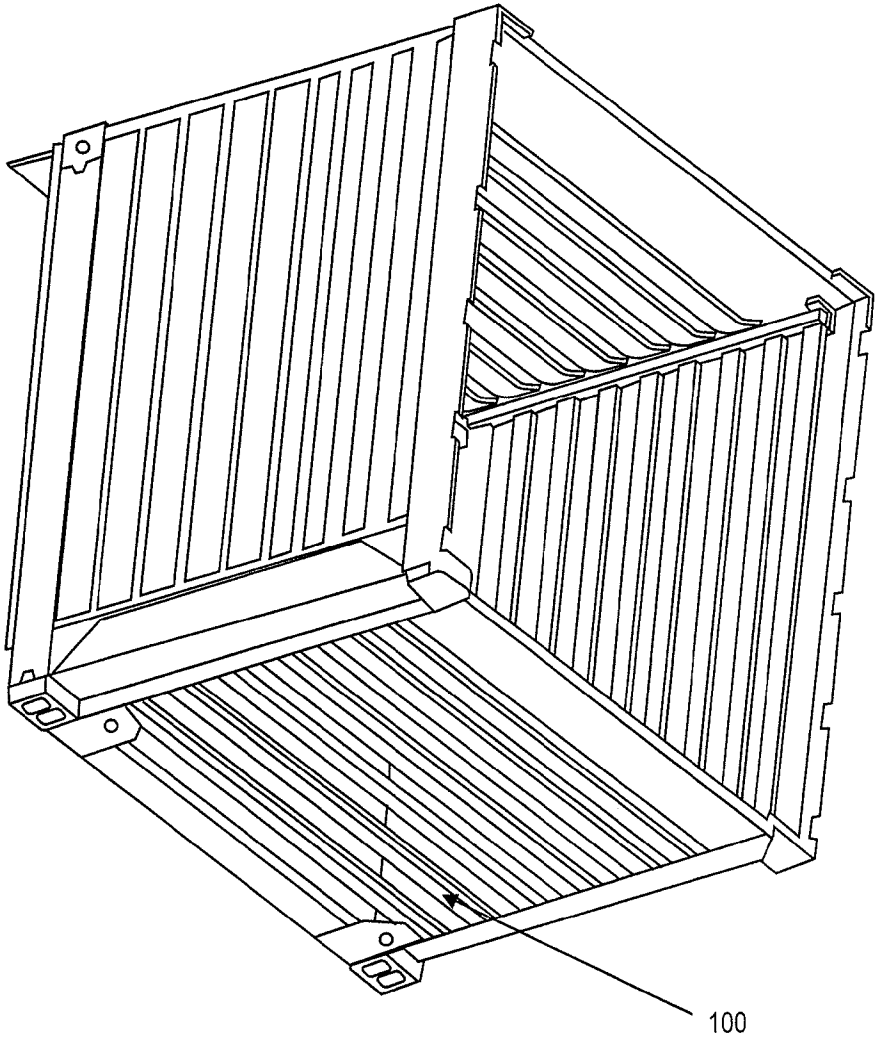

FIG. 13A shows a new design for a cross member used in container 10 according to an embodiment of the invention. The cross member 100 is in the form of an I-shaped beam where the I section is 75 mm, as shown. This cross member provides the structural support needed to stack and rack the containers in a variety of ways. As a result, the container 10 can be used in vessels, trailers and trains. The bottom wall of the container 10 comprises a plurality of cross beams. For example, the I-shaped cross member beams are placed at the base of the container and covered by a flat panel (e.g., floorboard) on top. FIG. 13B shows a partial container with the bottom view which illustrates the placement of the newly designed I-shaped cross members 100 in a 53 foot container.

In one embodiment, utilizing High Strength Steel for I-shaped cross member and I-shaped outrigger beams that are 75 mm high, results in increased internal height. Also, a gooseneck assembly height may be reset lower to gain more interior height. A gooseneck recess is designed for sitting in position on top of skeleton gooseneck chassis to avoid any transverse force during turning. Exemplary dimensions for a gooseneck channel may be as follows: Length 3,251 mm or 128", Width 1,029 mm or 40½", and Height 79 mm or 3⅛". The gooseneck tunnel may consist of one gooseneck tunnel top plate, a pair of tunnel side rails, one box section rear bolster and tunnel outriggers. The gooseneck tunnel may be designed to AAR standard. The 75 mm I-shaped cross members and the gooseneck assembly may provide the desired cubic capacity to accommodate the domestic 53 foot specification.

Another modification that may be made to container 10 from current 53 foot containers used on vessels, is to reduce the tare weight by 380 kg from 5630 kg to 5250 kg. The weight reduction is performed by utilizing high strength steel (HSS) that allows the reduction of the size of different structural parts, yet maintaining the required structural strength. The type of steel used is the Domex/Docal high strength steel which is commercially available from SSAB Tunnplat A.B. of Sweden. The table below illustrates the advantageous effect of utilizing high strength steel. As shown in the table, dimensions of various parts of the container may be reduced by using high strength steel, which results in reduced weight of those parts. In addition, reducing the dimensions of various parts provides the ability to increase the total capacity of the universal hybrid 53 foot container. For example, interior cubic capacity is increased by 2.4 cubic meter from 108.6 $m^3$ to 111 $m^3$. Interior width (panel) is increased by 9 mm from 2505 mm to 2514 mm, and interior height (panel) is increased by 49 mm from 2710 mm to 2759 mm. Moreover, door opening height is increased by 121 mm from 2597 mm to 2718 mm. These features allow for utilization of the universal hybrid 53 foot containers in the United States' domestic trades.

| | | 53 foot Ocean Spec | | New 53 foot Universal Hybrid Spec | | |
|---|---|---|---|---|---|---|
| No. | Item | structure & material | weight (kg) | structure & material | weight (kg) | variance |
| 1 | Crossmember | "C" section, 4 mm corten steel with 122 mm high | 524.70 | "I" beam, 75 mm high | 469.84 | (54.86) |
| 2 | Gooseneck tunnel | "Ω" section, 4 mm corten steel with 4.5 mm tunnel bow | 282.34 | 4.5 mm corten steel top plate with 4 mm tunnel bow and 4 mm H.S.S tunnel rail | 225.90 | (56.44) |
| 3 | Tunnel bolster | Box section, 4 mm corten steel with 150 mm high | 35.94 | Box section, 6 mm corten steel upper and 8 mm lower with 103 mm high | 61.65 | 25.71 |
| 4 | Door header | 4 mm corten steel with 138 mm high | 57.19 | 4.0 mm upper corten steel and 4.5 mm lower H.S.S with 66 mm high | 64.24 | 7.05 |
| 5 | Door sill | "G" section, 4.5 mm corten steel with 150 mm high | 33.09 | "G" section, 6 mm corten steel with 103 mm high | 32.72 | (0.37) |
| 6 | Door panel | 2.0 mm corten steel | 75.55 | 1.6 mm corten steel | 62.86 | (12.69) |
| 7 | Rear corner post | 6 mm corten steel outer and 12 mm hot roll channel inner | 156.50 | 6.0 mm H.S.S outer and inner | 130.87 | (25.63) |
| 8 | Front corner post | 6 mm corten steel | 141.86 | 4.5 mm H.S.S | 112.02 | (29.84) |
| 9 | Front panel | 2.0 mm corten steel with 45.6 mm depth corrugation | 100.84 | 1.6 mm corten steel with 45.6 mm depth corrugation | 81.69 | (19.15) |
| 10 | Intermediate header | 4 mm corten steel upper and 4.5 mm corten steel lower | 154.66 | 4.5 mm corten steel upper and 4.5 mm corten steel lower | 188.36 | 33.70 |
| 11 | Intermediate sill | Box section, 4 mm corten steel with 122 mm high | 33.19 | Box section, 4.5 mm upper and 4.5 mm lower corten steel with 103 mm high. | 47.66 | 14.47 |
| 12 | Intermediate post | 6 mm corten steel outer and inner, 4.5 mm corten steel stiffener | 342.56 | 6.0 mm H.S.S outer and inner | 287.73 | (54.83) |
| 13 | Side panel | 1.6 mm + 2.0 mm corten steel | 1097.45 | 40' position: 1.2 mm H.S.S + 1.6 mm corten steel; 53' position: 2.0 mm corten steel | 883.12 | (214.33) |
| 14 | Top side rail | 3.0 × 60 × 60 corten steel | 122.86 | 3.0 × 50 × 100 corten steel | 155.58 | 32.72 |
| 15 | Roof panel | 1.6 corten steel | 460.90 | 1.6 corten steel | 462.12 | 1.22 |

The corner fitting height can be modified to accommodate the new cross member design. Also, the maximum gross weight of the hybrid container is reduced from 30,480 kg (for the domestic version) to 28,000 kg to accommodate marine transportation.

Figure 14:
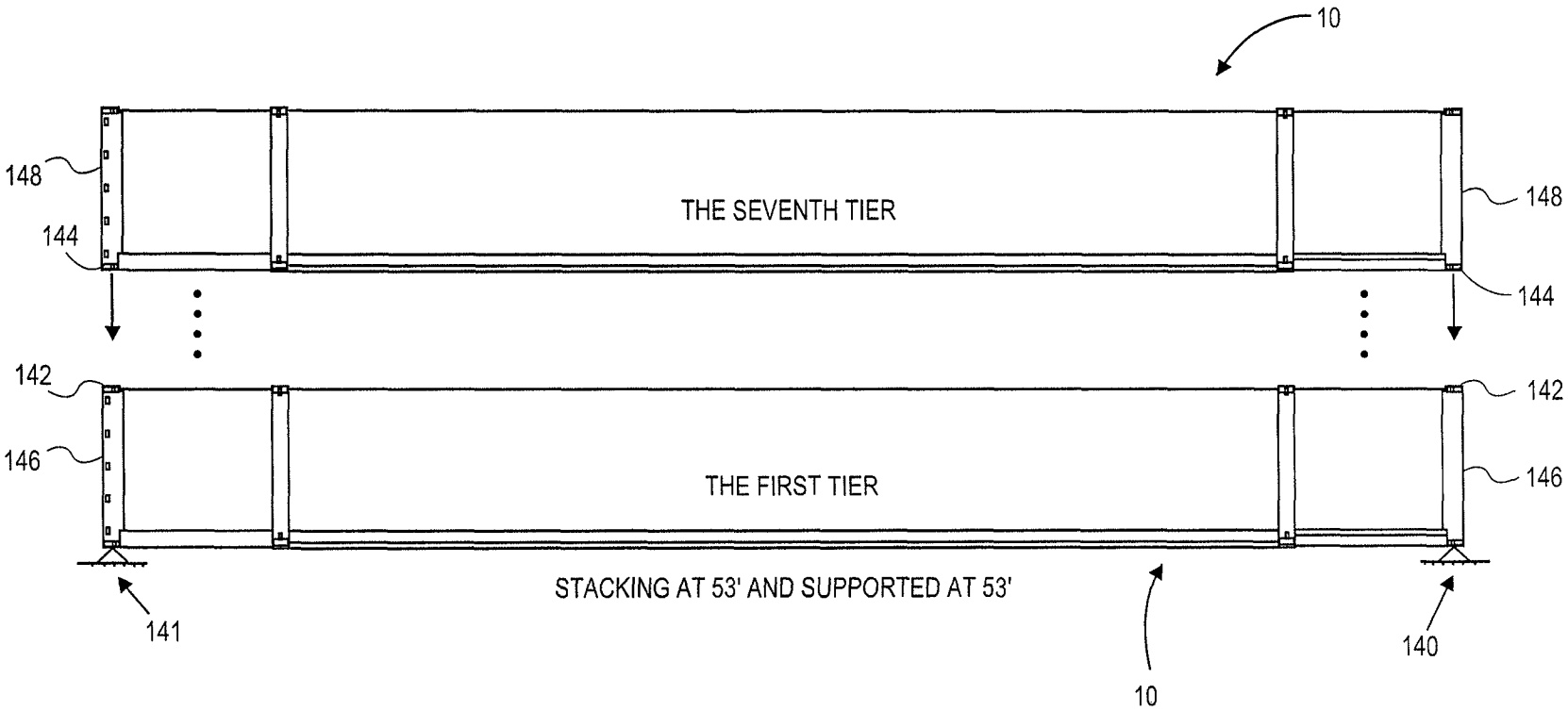
FIG. 14 shows a stacked view of a container according to an embodiment of the invention.

FIG. 14 shows shipping containers 10 stacked using the corner fitting elements 142 and 144. The first tier shipping container 10 is supported by using corner fitting elements 140 and 141 (e.g., at a 53 foot position). An attachment device can be used to secure the first tier container to the vessel using corner fitting elements 140 and 141 (e.g., stow the container directly to deck). For example, an attachment device such as a manual lock may be used to lock the first tier container to the bottom of the vessel.

An attachment device can be used to secure the containers 10 together (e.g., secure the first tier container 10 to a second tier container 10, etc.) by utilizing the outer aperture of each corner fitting element 142 and 144 of each container 10. Preferably an attachment device such as a semi-automatic twist lock is used. A semi-automatic twist lock is less costly than other attachment devices such as a fully automatic twist lock. Vertical support frames 146 and 148 act as reinforcement stacking posts. The outer apertures are located above or below each end of the vertical support frames 146 and 148, and thus, when the semi automatic twist lock is engaged through the outer apertures, it engages the vertical support frames of the first container to the vertical support frame of the next container, and so forth all the way up to the top of the stack. When these vertical support frames are engaged together, the bottom lock has more support to hold on to these frames.

Figure 15:
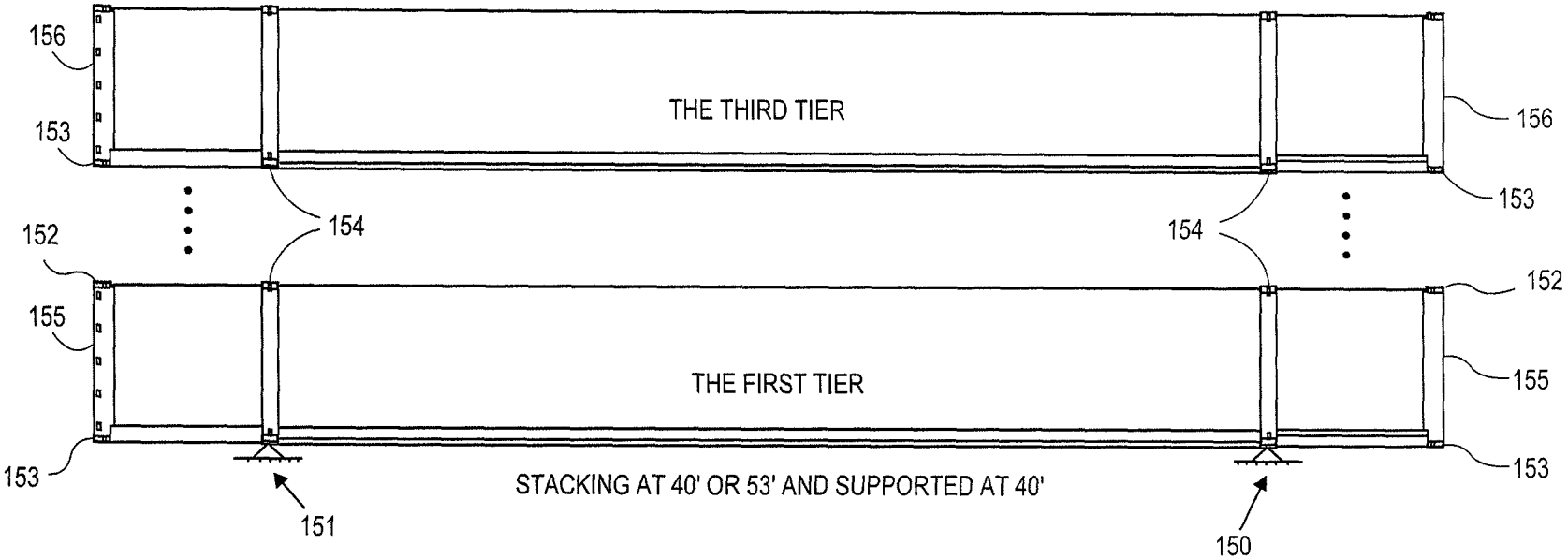
FIG. 15 shows a stacked view of a container according to an embodiment of the invention.

In contrast, FIG. 15 shows a first tier container supported at a 40 foot position by utilizing intermediate fitting elements 150 and 151. The first tier container is supported (e.g., locked) to the bottom of the vessel using an attachment device such as a manual lock. The containers that stack on top of the first tier container can be stacked at either the 40 foot position using inner apertures of the intermediate fitting elements 154 and using a fully automatic twist lock or at the 53 foot position using outer apertures or corner fitting elements 152 and using a semi-automatic twist lock. A semi-automatic twist lock typically cannot be used at the 40 foot position because there is no way for human intervention to engage the semi automatic twist lock since it is secured to an inner aperture that cannot be reached outside of the container. Because the containers are only supported at a 40 foot position (e.g., the first tier is locked to the vessel at the 40 foot position using inner fitting elements 150 and 151), they can only be stacked three tiers high, regardless of whether they are stacked at a 40 foot position or a 53 foot position.

Figure 16:
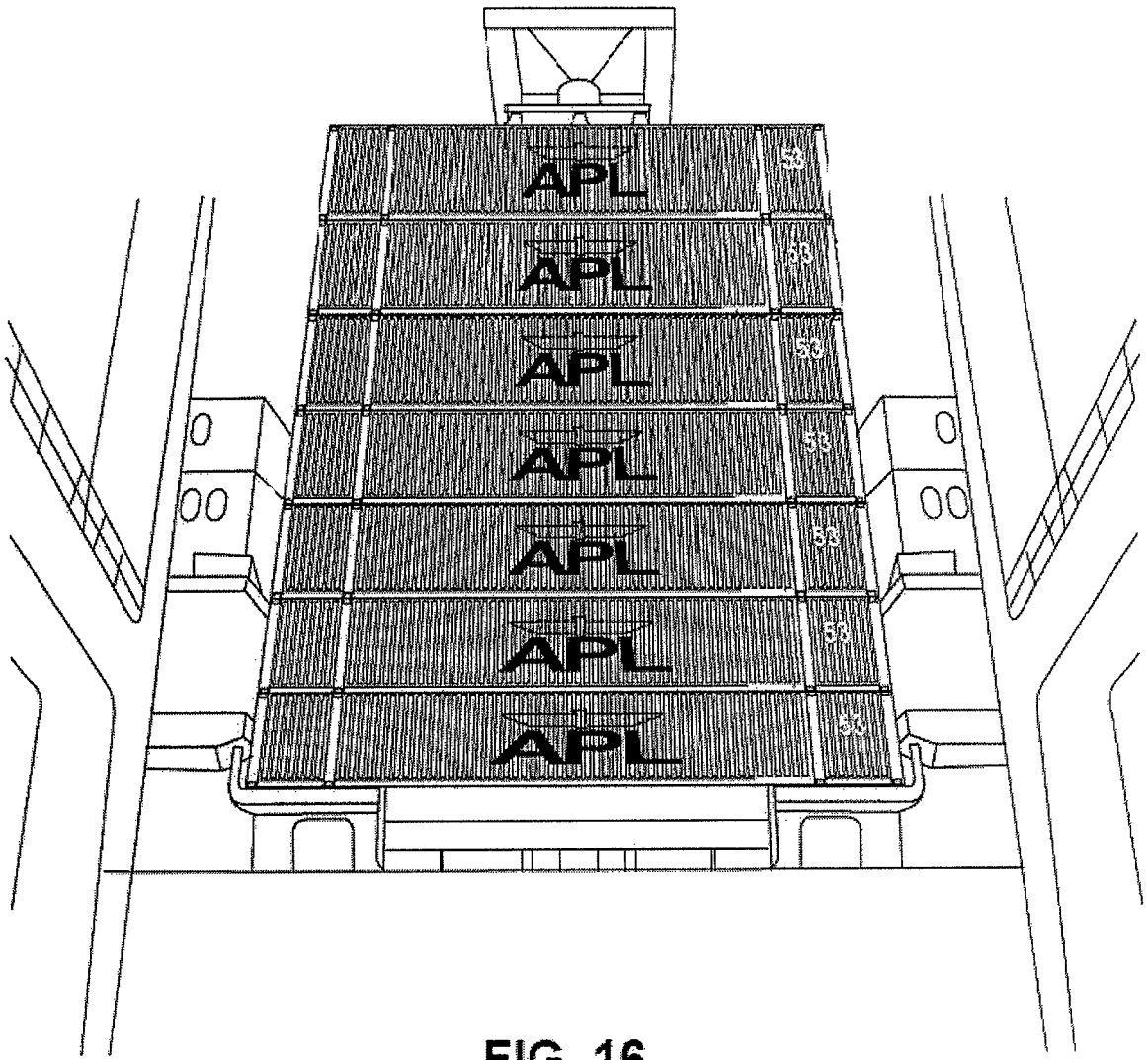
FIG. 16 shows a stack of containers on a vessel according to an embodiment of the invention.

FIG. 16 shows 53 foot containers stacked on a vessel.

The universal hybrid containers may advantageously be used in configurations that other containers cannot be used. For example, the hybrid design allows containers to be stacked seven containers high (192 metric ton) at a 53 foot position on vessels, whereas domestic 53 foot containers do not have this capability. Also, the hybrid containers allow containers to be stacked five containers high (91.4 metric ton) at a 40 foot position on vessels, whereas domestic 53 foot containers are limited to stacking only two high (50 metric ton). Moreover, hybrid containers offer ISO standard 15,240 kg racking capability at a 53 foot position on vessels, whereas domestic 53 foot containers do not have this capability. In addition, hybrid containers offer 15,240 kg racking capability at 40 foot position, whereas domestic 53 foot container are limited to a range of 6,860 kg to 10,160 kg racking capability.

In addition to the advantages described above, the 53 foot universal hybrid container can also have a positive environmental impact. Using the 53 foot universal hybrid containers for domestic shipping with trailers results in reduction of fuel consumption. The increased capacity of the universal hybrid container, allows for transportation of more goods with fewer trailers. Reduction of the overall number of trailers used to haul goods can have an enormous impact on the emission of carbon dioxide and conservation of energy resources on a global scale.

Moreover, use of the universal hybrid container eliminates the need to offload and reload the goods from one type of container to another type of container. The universal hybrid container can be used on vessels to ship the goods from Asia to America, and then used on trailers or trains to ship goods across America. This capability directly translates to reduced cost and increased efficiency.

Various components of the shipping container 10 according to embodiments of the invention conform to ISO standards and U.S. shipping requirements. For example, the outer aperture dimensions in the corner fitting element may conform to ISO standards for aperture dimensions. Another example is that container 10 has a racking force of 15,240 kg and a stacking capability of 192,000 kg according to embodiments of the invention. Thus, embodiments of the invention can have a racking force of greater than about 14,000 kg when the containers are stacked at least five containers high. Further, embodiments of the invention have been tested and certified by the American Bureau of Shipping, as shown in the table below.

| ABS TEST NO & DESCRIPTION | | TEST FORCE | INTERNAL LOAD | SEQUENCE |
|---|---|---|---|---|
| 7.11.1 | Dimensional Check | Per Rules | N/A | 1.30 |
| 7.11.2a | Stacking @ 53' & supported @ 53' | 86,400 kg/Post | 45,150 kg | 2* |
| 7.11.2b | Stacking @ 40' & supported @ 40' | 41,150 kg/Post | 49,614 kg | 4* |
| 7.11.2c | Stacking @ 53' & supported @ 40' | 41,150 kg/Post | 45,150 kg | 3* |
| 7.11.3 | Lifting, Top @ 40' position | 60,960 kg | 55,710 kg | 5 |
| 7.11.4 | Lifting, Bottom | — kg | N/A | N/A |
| 7.11.5 | Lifting, FLP, loaded | — kg | N/A | N/A |
| 7.11.6 | Lifting, FLP, empty | — kg | N/A | N/A |
| 7.11.7 | Lifting, Gap | — kg | N/A | N/A |
| 7.11.8 | Floor Strength, Concentrated | 7,260 kg | N/A | 9 |
| 7.11.9a | Restraint @ 53' position | 60,960 kg | 25,230 kg | 7 |
| 7.11.9b | Restraint @ 40' position | 60,960 kg | 25,230 kg | 8 |
| 7.11.10a | End Panel, Front | 10,092 kg | N/A | 23 |
| 7.11.10b | End Panel, Rear | 10,092 kg | N/A | 23 |
| 7.11.10c | End Panel, Rear | 17,661 kg | N/A | 29 |
| 7.11.11 | Side Panel | 13,650 kg | N/A | 24 |
| 7.11.12 | Roof Strength | 300 kg | N/A | 17 |
| 7.11.13a | Racking, Trans, Forced @ 53' & restrained @ 53' | 15,240 kg | N/A | 11 |
| 7.11.13b | Racking, Trans, Forced @ 40' & restrained @ 40' | 15,240 kg | N/A | 12 |
| 7.11.13c | Racking, Trans, Forced @ 53' & restrained @ 40' | 15,240 kg | N/A | 13 |
| 7.11.14a | Racking, Longitudinal, Forced @ 53' & restrained @ 53' | 7,620 kg | N/A | 14 |
| 7.11.14b | Racking, Longitudinal, Forced @ 53' & restrained @ 40' | 7,620 kg | N/A | 15 |
| 7.11.14b | Racking, Longitudinal, Forced @ 40' & restrained @ 40' | 30,480 kg | N/A | 16 |
| 7.11.15 | Cargo Securing Devices | 2,000/1,500 kg | N/A | 22 |
| 7.11.16 | Weather tightness | Per rules | N/A | 28 |
| Other Test | Lifting from Top, Dynamic Test | 1500 cycles × 30,480 kg | 25,230 kg | 25 |
| | Straddle Lifting | 51,816 kg | 46,566 kg | 10 |
| | Restraint, Transverse @ 53' | 9,144 kg | N/A | 18 |
| | Restraint, Transverse @ 40' | 9,144 kg | N/A | 19 |
| | Cargo Loading Test, b: [w/19,780 kg on mid. 3 m × 1.2 m (L × W) area] | 50,460 kg | 50,460 kg | 20 |
| | Floor Deflection Test | 30,480 kg | 25,230 kg | 6 |
| | Dynamic Lift Truck Test of Container on Chassis | 3000 cycles × 18,000 lbs | N/A | 27# |
| | Racking, Transverse, Dynamic (w/10,668 kg vertical load @ each aperture) | 2500 cycles × 4,572 kg | N/A | 26 |

-continued

| ABS TEST NO & DESCRIPTION | TEST FORCE | INTERNAL LOAD | SEQUENCE |
|---|---|---|---|
| Vertical Tension | 15,240 kg/post | N/A | 21 |
| Rating: (CSC) | | | |
| Max. Gross Weight (MGW); | 28,000 kg | 61,730 lbs | |
| Tare: | 5,250 kg | 11,570 lbs | |
| Maximum Permissible Payload: | 22,750 kg | 50,160 lbs | |

*Offsets are required

#Manufacturer's proposed test value

Any recitation of "a", "an" or "the" is intended to mean "one or more" unless specifically indicated to the contrary.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

What is claimed is:

1. A method of stacking shipping containers, comprising:

obtaining a first fifty-three foot shipping container, wherein the first fifty-three foot shipping container comprises a top wall, a bottom wall, a first side wall, a second side wall, a front wall and a rear wall, wherein the first fifty-three foot container further comprises a first top corner where the top wall, the first side wall and the front wall meet, a second top corner where the top wall, the second side wall and the front wall meet, a third top corner where the top wall, the second side wall and the rear wall meet, and a fourth top corner where the top wall, the first side wall and the rear wall meet, the first fifty-three foot shipping container further comprising a first top corner fitting element disposed at the first top corner, a second top corner fitting element disposed at the second top corner, a third top corner fitting element disposed at the third top corner, and a fourth top corner fitting element disposed at the fourth top corner, each top corner fitting element having an outer aperture located at the outer part of each top corner fitting element underneath a vertical support frame;

placing, using a mechanical device, a second fifty-three foot shipping container on top of the first fifty-three foot shipping container, wherein the second fifty-three foot shipping container comprises a top wall, a bottom wall, a first side wall, a second side wall, a front wall and a rear wall, wherein the second fifty-three foot container further comprises a first bottom corner where the bottom wall, the first side wall and the front wall meet, a second bottom corner where the bottom wall, the second side wall and the front wall meet, a third bottom corner where the bottom wall, the second side wall and the rear wall meet, and a fourth bottom corner where the bottom wall, the first side wall and the rear wall meet, the second fifty-three foot shipping container further comprising a first bottom corner fitting element disposed at the first bottom corner, a second bottom corner fitting element disposed at the second bottom corner, a third bottom corner fitting element disposed at the third bottom corner, and a fourth bottom corner fitting element disposed at the fourth bottom corner, each bottom corner fitting element having an outer aperture located at the outer part of each bottom corner fitting element underneath a vertical support frame; and manipulating a lock to connect the first fifty-three foot shipping container and the second fifty-three foot shipping container using the outer aperture located at the outer part of each top corner fitting element of the first fifty-three foot shipping container and the outer aperture located at the outer part of each bottom corner fitting element of the second fifty-three foot shipping container, wherein the first fifty-three foot shipping container is configured to allow up to six fifty-three foot shipping containers to be stacked on top of the first fifty-three foot shipping container utilizing the outer aperture of each corner fitting element.

2. The method of claim 1 wherein the lock is a semi-automatic twist lock.

3. The method of claim 1 wherein when the first fifty-three foot shipping container has six shipping containers stacked on top of the first fifty-three foot shipping container, the shipping containers can sustain a racking force of 15,240 kg.

4. The method of claim 1 wherein the first fifty-three foot shipping container and the second fifty-three foot shipping container are configured to be shipped by vessel, truck, and rail.

5. The method of claim 1 wherein the first fifty-three foot shipping container further comprises a set of top intermediate fitting elements, each top intermediate fitting element located approximately 13 feet from each top corner fitting element and each top intermediate fitting elements having an inner aperture.

6. The method of claim 5 wherein the second fifty-three foot shipping container further comprises a set of bottom intermediate fitting elements, each bottom intermediate fitting element located approximately 13 feet from each bottom corner fitting element, and each bottom intermediate fitting elements having an inner aperture and an outer aperture.

7. The method of claim 6 wherein the first fifty-three foot shipping container is configured to be connected to the second fifty-three foot shipping container using the inner aperture of each top intermediate fitting element of the first fifty-three foot shipping container and the inner aperture of each bottom intermediate fitting element of the second fifty-three foot shipping container.

8. The method of claim 7 wherein the first fifty-three foot shipping container is configured to allow up to four containers to be stacked on top of the first fifty-three foot shipping container by utilizing the set of top intermediate fitting elements.

9. The method of claim 1 wherein the first fifty-three foot shipping container is configured to be stowed directly to a deck of a vessel without utilizing any convertible adaptor to secure the first fifty-three foot shipping container to the deck.

10. The method of claim 9 wherein the first fifty-three foot shipping container and the second fifty-three foot shipping container are configured to be shipped by vessel without utilizing any adapters to stack the second fifty-three foot shipping container on top of the first fifty-three foot shipping container on the vessel.

* * * * *